US010850154B2

(12) United States Patent
Baker et al.

(10) Patent No.: US 10,850,154 B2
(45) Date of Patent: Dec. 1, 2020

(54) STORABLE EXERCISE BENCH

(71) Applicant: NAUTILUS, INC., Vancouver, WA (US)

(72) Inventors: Bryce C. Baker, Vancouver, WA (US); Ryan J. Pohl, Camas, WA (US)

(73) Assignee: Nautilus, Inc., Vancouver, WA (US)

( * ) Notice: Subject to any disclaimer, the term of this patent is extended or adjusted under 35 U.S.C. 154(b) by 81 days.

(21) Appl. No.: 16/018,969

(22) Filed: Jun. 26, 2018

(65) Prior Publication Data

US 2018/0369633 A1 Dec. 27, 2018

Related U.S. Application Data

(60) Provisional application No. 62/524,749, filed on Jun. 26, 2017.

(51) Int. Cl.

| | |
|---|---|
| ***A63B 21/00*** | (2006.01) |
| ***A63B 23/00*** | (2006.01) |
| ***A63B 23/02*** | (2006.01) |
| ***A63B 21/078*** | (2006.01) |
| ***A63B 71/02*** | (2006.01) |

(52) U.S. Cl.

CPC ..... *A63B 21/4029* (2015.10); *A63B 23/00* (2013.01); *A63B 23/0211* (2013.01); *A63B 21/078* (2013.01); *A63B 2071/025* (2013.01); *A63B 2210/50* (2013.01); *A63B 2225/09* (2013.01)

(58) Field of Classification Search

CPC ..... A63B 21/4029; A63B 21/078; A63B 2071/025; A63B 2210/50; A63B 2225/09

See application file for complete search history.

(56) References Cited

U.S. PATENT DOCUMENTS 5,649,885 A * 7/1997 Liljenquist ..... A63B 21/068 482/57
5,865,713 A * 2/1999 Hsu ..... A63B 21/4029 482/72
6,030,324 A * 2/2000 McBride ..... A63B 21/072 482/142

(Continued)

FOREIGN PATENT DOCUMENTS

WO 2006023550 A2 3/2006
WO 2014201296 A1 12/2014

OTHER PUBLICATIONS

PCT International Search Report and Written Opinion, PCT Application No. PCT/US2018/039535 dated Sep. 18, 2018, 14 pages.

*Primary Examiner* — Jennifer Robertson
*Assistant Examiner* — Andrew M Kobylarz
(74) *Attorney, Agent, or Firm* — Dorsey & Whitney LLP

(57) ABSTRACT

A storable exercise bench is provided. The exercise bench may include a frame including at least one beam operatively coupled to first and second floor supports and a member operatively coupled with the at least one beam. The exercise bench may be positioned into an operating position in which the first and second floor supports support the at least one beam and the member, and the at least one beam runs generally horizontally in reference to a support surface. The exercise bench may be positioned into a storage position in which the second floor support and the member support the at least one beam and the first floor support, and the at least one beam runs generally vertically in reference to the support surface.

19 Claims, 35 Drawing Sheets

(56) References Cited

U.S. PATENT DOCUMENTS

| | | | | |
|---|---|---|---|---|
| 6,350,221 | B1 | 2/2002 | Krull | |
| 7,753,830 | B1 * | 7/2010 | Marsh | A63B 23/03525 482/142 |
| 2003/0195095 | A1 * | 10/2003 | Endelman | A63B 21/023 482/142 |
| 2006/0035772 | A1 * | 2/2006 | Golesh | A63B 21/4031 482/142 |
| 2007/0155604 | A1 * | 7/2007 | Hockemeyer | A63B 21/4029 482/142 |
| 2014/0371034 | A1 * | 12/2014 | Mortensen | A63B 22/0002 482/52 |
| 2016/0001123 | A1 * | 1/2016 | Parrish, Jr. | A63B 22/0076 482/72 |

* cited by examiner

STORABLE EXERCISE BENCH

CROSS-REFERENCE TO RELATED APPLICATION

This application claims, under 35 U.S.C. § 119(e), the benefit of U.S. Provisional Patent Application No. 62/524,749, filed on Jun. 26, 2017, entitled "Storable Exercise Bench," which application is hereby incorporated by reference in its entirety.

TECHNICAL FIELD

The present disclosure relates generally to physical fitness and personal training and more specifically to a storable exercise bench.

BACKGROUND

Various devices and systems exist to perform a variety of fitness training exercises. As an example, exercise benches exist to provide a platform or support surface for a user to perform various exercises or workouts as part of a strength or fitness program. These exercise benches, however, can be bulky, difficult to adjust, and difficult to store when not in use.

It is therefore desirable to provide an improved exercise bench that addresses at least in part the above described problems and/or which more generally offers improvements or an alternative to existing arrangements.

SUMMARY

The present disclosure generally provides a storable exercise bench. The exercise bench is extendable or collapsible depending on user preference. For example, the exercise bench may be configured into an operating or use position to permit a user to perform various exercises. The exercise bench may be configured into a storage position to create/reduce a footprint size of the exercise bench and permit the exercise bench to be stored in a relatively small space. In some embodiments, a portion of the exercise bench may support both the performance of various exercises as well as storing the exercise bench in the storage position. For example, the exercise bench may include a member movable between first and second positions. In the first position, the member may be positioned to allow a user to perform various exercises, such as by including an ankle pad supporting the lower body of the user. In the second position, the member may support the exercise bench in the storage position, such as in an upright position. For instance, in its second position, the member may form a base in combination with a frame of the exercise bench to support the exercise bench in an upright position.

Embodiments of the present disclosure may include a storable exercise bench. The exercise bench may include a frame including at least one beam operatively coupled to first and second floor supports and a member operatively coupled with the at least one beam. The exercise bench may be positioned into an operating position in which the first and second floor supports support the at least one beam and the member, and the at least one beam runs generally horizontally in reference to a support surface. The exercise bench may be positioned into a storage position in which the second floor support and the member support the at least one beam and the first floor support, and the at least one beam runs generally vertically in reference to the support surface.

Embodiments of the present disclosure may include a storable exercise bench. The exercise bench may include a frame including at least one beam operatively coupled to first and second floor supports, a wheel, and a wheel housing operatively associated with the wheel to at least partially cover the wheel. The wheel housing may be arranged to support the exercise bench in an upright storage position in which the at least one beam runs generally vertically in reference to a support surface.

Embodiments of the present disclosure may include a storable exercise bench. The exercise bench may include a backrest, a seat, and a frame including a first beam portion for supporting the backrest and a second beam portion for supporting the seat. The geometry of the first beam portion and the second beam portion may be such that the first and second beam portions are located interiorly of support points of the exercise bench when the exercise bench is positioned in an upright storage position.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 6:
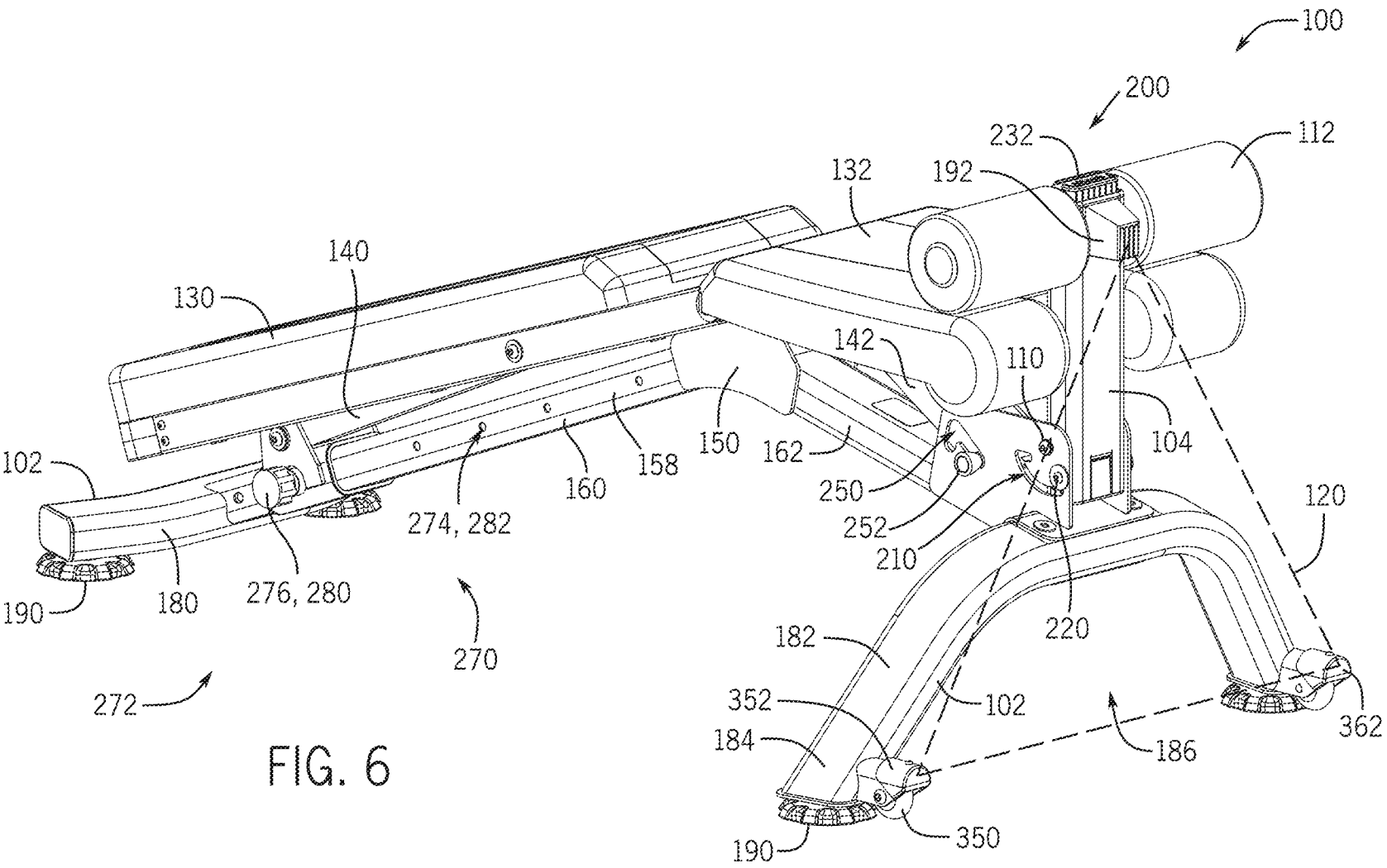
FIG. 6 is an isometric view of the exercise bench of FIG. 1 in a storage position.
Figure 8:
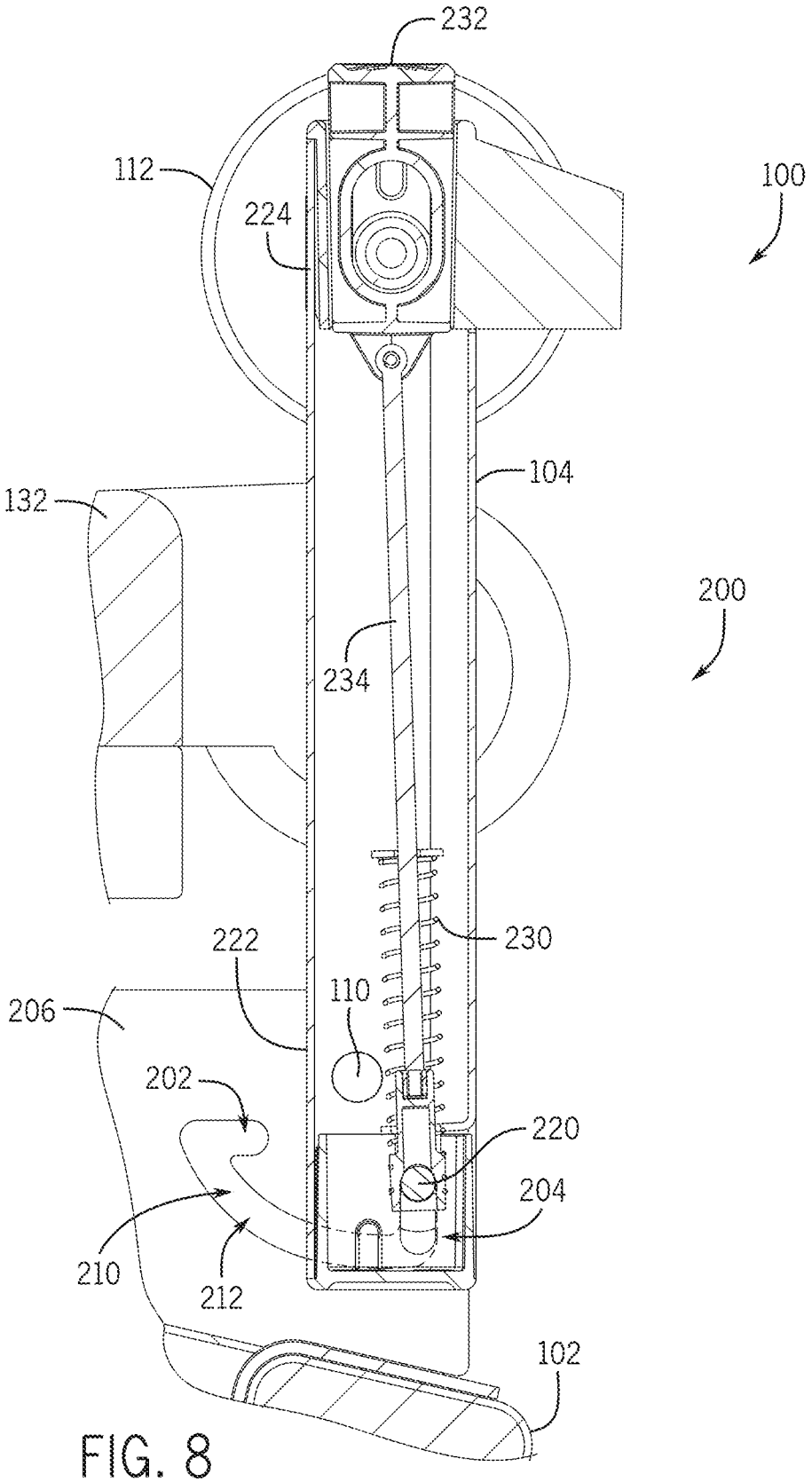
FIG. 8 is a cross-sectional view of an adjustment assembly operable to move a movable member of the exercise bench between first and second positions and taken along line 8-8 of FIG. 7.
Figure 9:
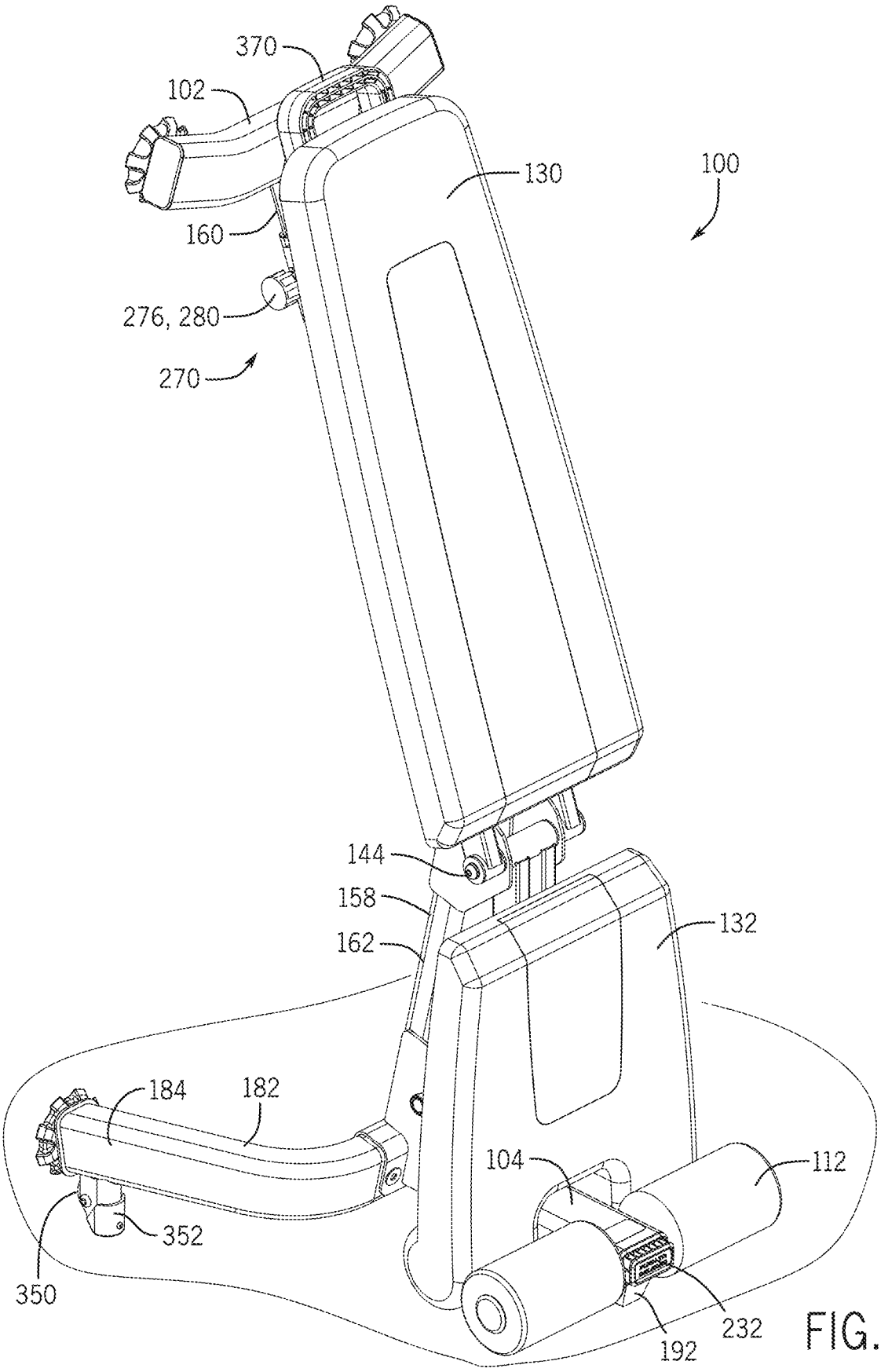
FIG. 9 is an isometric view of the exercise bench in an upright storage position.

FIGS. 1-22 illustrate an exemplary embodiment of a storable exercise bench 100 movable between an operating or use configuration (see FIGS. 1-5, for instance) and a storage position (see FIGS. 6 and 9, for instance). As described herein, in an operating or use position, the exercise bench 100 may permit a user to perform various exercises thereon, such as various strength and/or fitness exercises (e.g., dumbbell exercises, barbell exercises, resistance band exercises, bodyweight exercises, etc.). In a storage position, a footprint of the exercise bench 100 may be created and/or reduced to permit the exercise bench 100 to be stored in a relatively small space, such as in an upright position. For example, a storage footprint of the exercise bench 100 may be created when the exercise bench 100 is in a storage position. The storage footprint may be smaller than the footprint of the exercise bench 100 when in its operating position. This may facilitate easy storage of the exercise bench 100, such as allowing the exercise bench 100 to be safely stored in small spaces (e.g., in closets, in a small space in crowded exercise rooms, etc.). In one example, the exercise bench 100 may be oriented to rest upright on end to be stored in a vertically-oriented position.

As detailed below, a portion of the exercise bench 100 may be moved between positions to position the exercise bench 100 in its operating and storage positions. In one embodiment, the movable portion of the exercise bench 100 may support both the performance of various exercises while the exercise bench 100 is in its operating position as well as the storing of the exercise bench 100 when the exercise bench 100 is in its storage position. For example, as detailed more fully below, a portion of the exercise bench 100 that facilitates the performance of at least one exercise may be selectively moved to a position allowing the exercise bench 100 to be stored in an upright position.

An embodiment of the exercise bench 100 may include a frame 102 and a movable member 104 operatively coupled to the frame 102. The member 104, which may be referred to as a bar, a leg support, or an ankle pad support, among others, may be movably coupled to the frame 102, such as pivotably coupled to the frame 102 about a pivot axis 110. In some embodiments, the member 104 may be operatively coupled with an ankle pad 112. For example, the member 104 may support the ankle pad 112 in a position aiding performance of various strength and/or fitness exercises, as detailed below.

Figure 1:
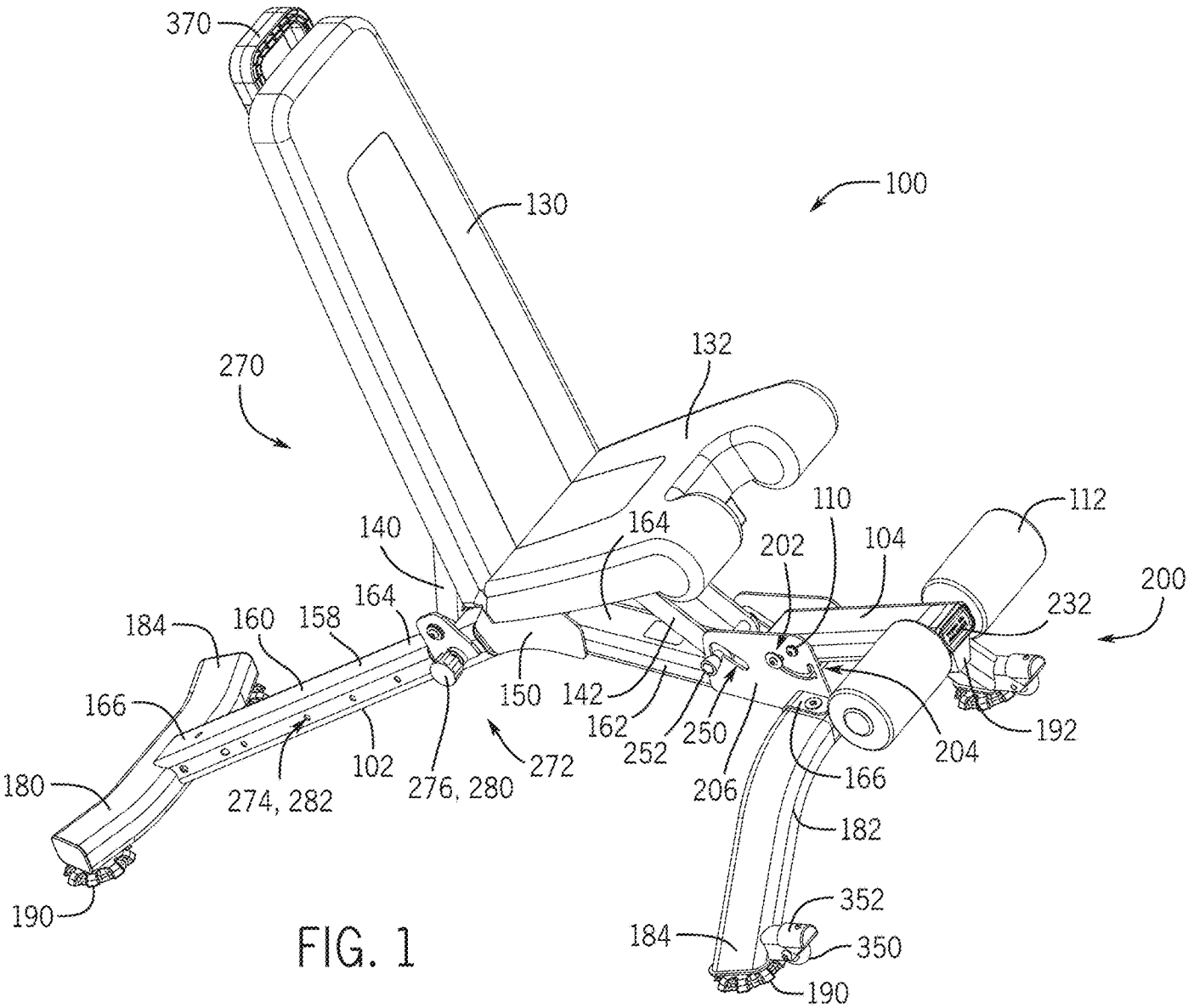
FIG. 1 is an isometric view of an exercise bench in an operating position with a backrest of the exercise device in a first position.
Figure 2:
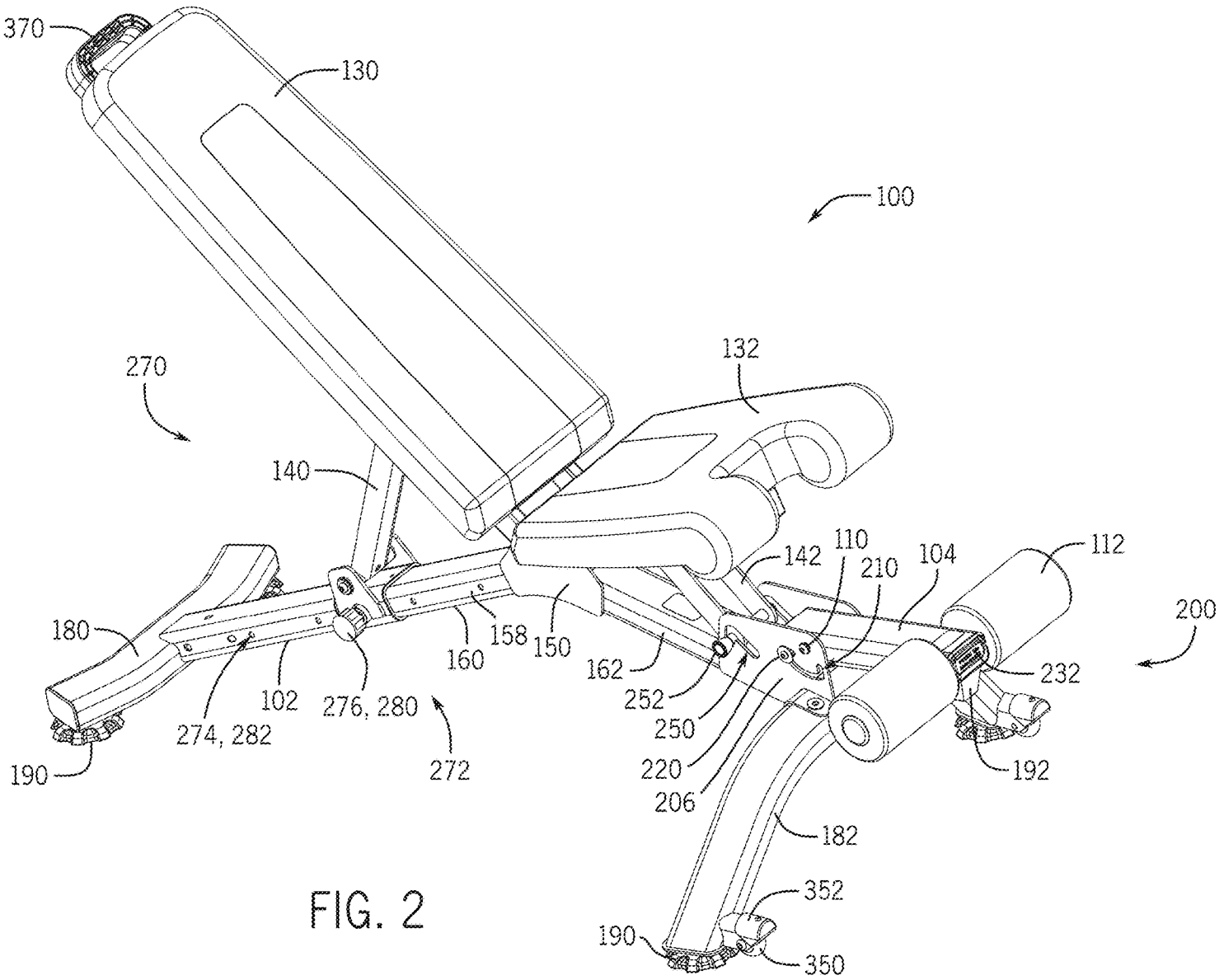
FIG. 2 is an isometric view of the exercise bench of FIG. 1 with the backrest in a second position.
Figure 3:
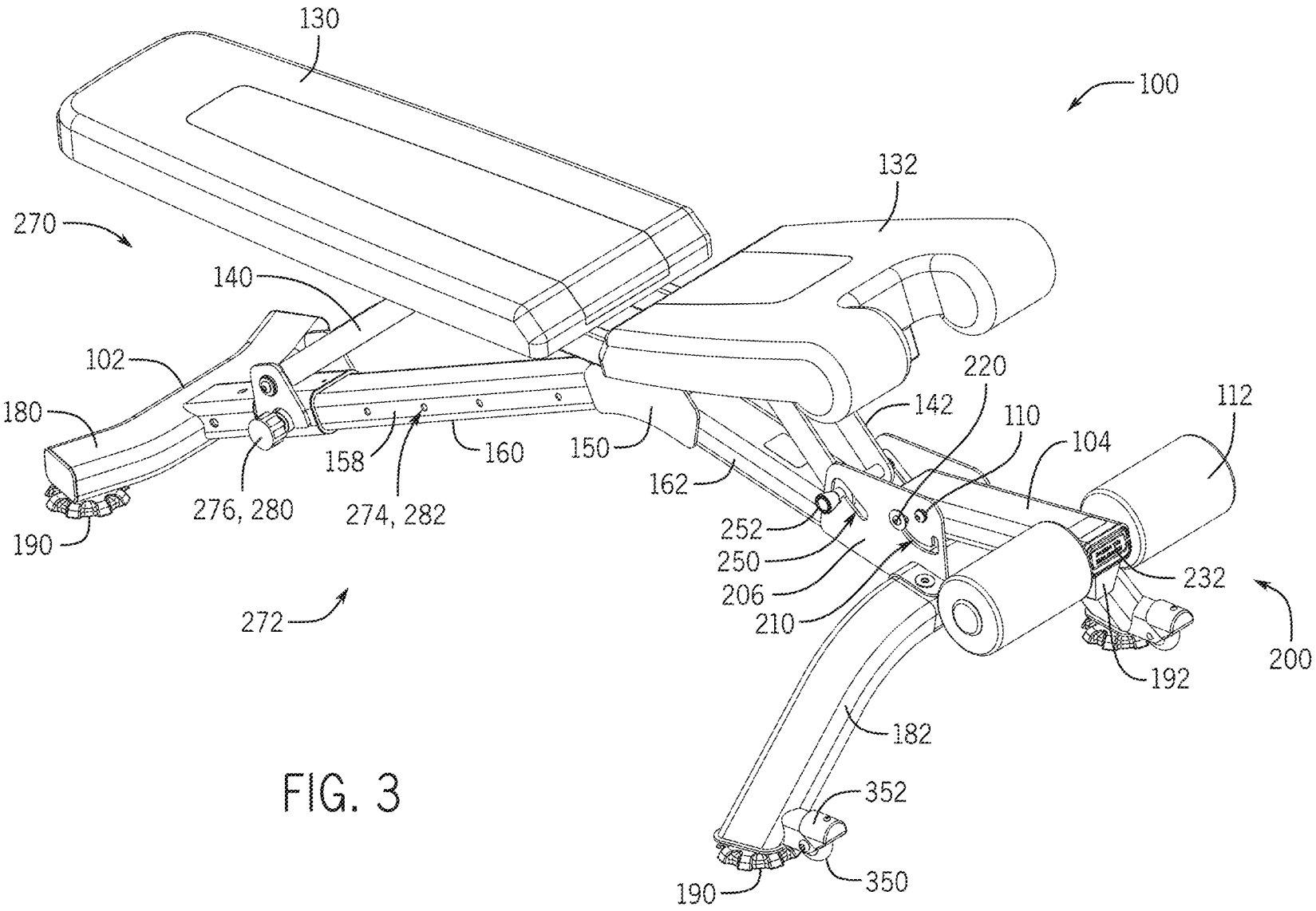
FIG. 3 is an isometric view of the exercise bench of FIG. 1 with the backrest in a third position.
Figure 4:
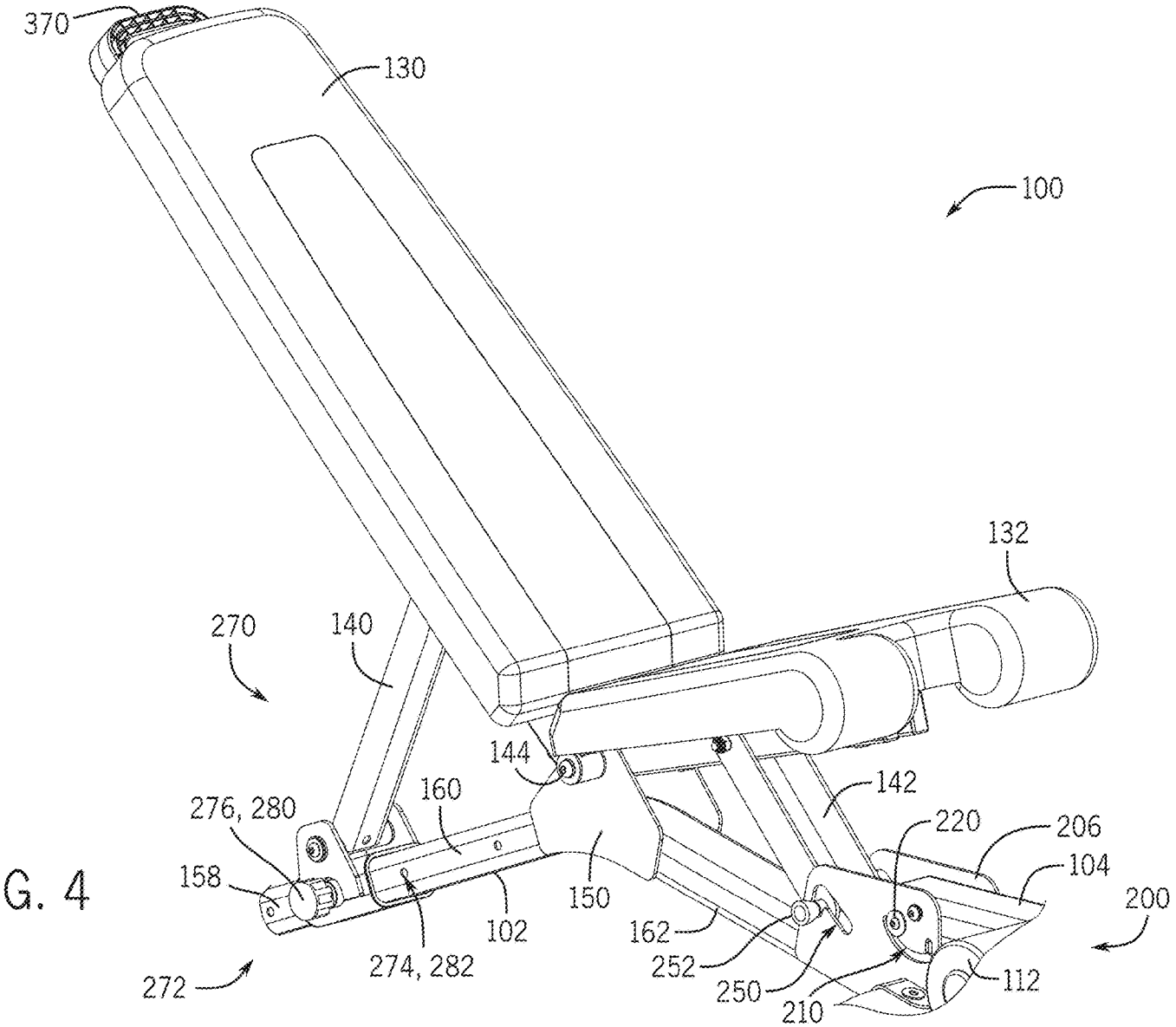
FIG. 4 is an enlarged, fragmentary isometric view of a seat of the exercise bench in an operating position and the backrest in the second position.
Figure 5:
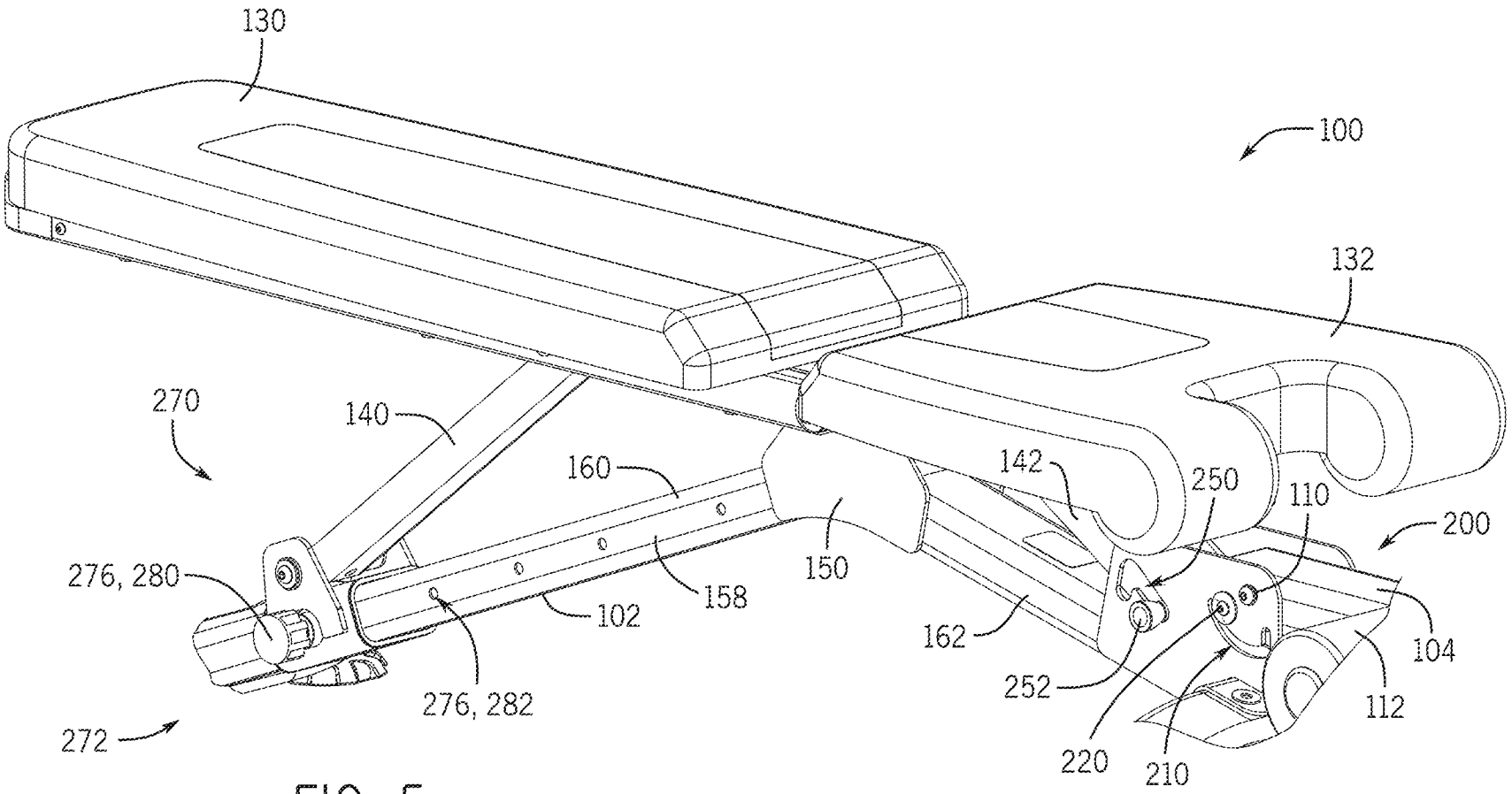
FIG. 5 is an enlarged, fragmentary isometric view of the seat of FIG. 4 in a storage position and the backrest in the third position.

As described herein, the member 104 may be selectively movable relative to the frame 102 between first and second positions (see FIGS. 1 & 6, respectively). In the first position, the member 104 may extend from the frame 102 in a first configuration to allow a user to perform various exercises. For example, in its first position, the member 104 may be positioned to engage the user's lower body (e.g., the user's ankle, calf, and/or shin area) to support the user during exercise. For example, when the member 104 is positioned in its first position, the ankle pad 112 may be positioned to engage the user's ankle, calf, and/or shin area to provide a steady base for a user to perform various exercises. In the second position, the member 104 may extend from the frame 102 in a second configuration to allow storage of the exercise bench 100. For example, in its second position, the member 104 may be positioned to form a base 120 in combination with the frame 102 (see FIG. 6) to support the exercise bench 100 in a storage position, such as in an upright position, as explained below. As described herein, the member 104 may rotate about the pivot axis 110 to move between its first and second positions.

The exercise bench 100 may include a backrest 130 and a seat 132. Each of the backrest 130 and the seat 132 may be supported by the frame 102. For example, the exercise bench 100 may include a post 140 movably (e.g., pivotably) coupled to the backrest 130 and engaged (or engageable) with the frame 102 to support the backrest 130 in a plurality of positions, such as in a plurality of discrete positions or in an infinite number of positions. For example, the post 140 may be pivotably coupled to the backrest 130 (such as adjacent a rear center portion of the backrest 130) and slidably coupled to the frame 102. In such embodiments, sliding movement of the post 140 along a portion of the frame 102 may move the backrest 130 between positions. In like manner, the exercise bench 100 may include a seat post 142 movably (e.g., pivotably) coupled to the seat 132 and engaged (or engageable) with the frame 102 to support the seat 132 in a plurality of positions (either in a plurality of discrete positions or in an infinite number of positions), as explained below.

In one embodiment, each of the backrest 130 and the seat 132 may be pivotably coupled to the frame 102 to allow angular movement of each of the backrest 130 and the seat 132 relative to the frame 102. For example, as explained below, each of the backrest 130 and the seat 132 may rotate about a common pivot axis 144 (see FIG. 9, for instance) defined on the frame 102 (such as by a bracket 150 extending from the frame 102) to angularly position each of the backrest 130 and the seat 132 relative to the frame 102 as desired. For instance, the backrest 130 may be rotated about the common pivot axis 144 to define an inclined surface (see FIG. 1), a flat surface (see FIG. 5), or a declined surface (see FIG. 6) to provide a desired exercise characteristic or foundation. The seat 132 may pivot about the common pivot axis 144 in a similar manner as desired. In one embodiment, the seat 132 may be rotated about the common pivot axis 144 to allow the exercise bench 100 to be positioned in its operating and storage positions. For example, the seat 132 may be movable between first and second positions (see FIGS. 4 and 5, respectively). In its first position, the seat 132 may inhibit the member 104 from moving into its second position. For instance, in the first position of the seat 132, movement of the member 104 towards its second position may cause the ankle pad 112 of the member 104 to engage the seat 132 prior to the member 104 being positioned in its second position. In the second position of the seat 132, the member 104 may be free to move into its second position. For example, in its second position, the seat 132 may be positioned to allow movement of the ankle pad 112 thereby to position the member 104 into its second position. In this manner, movement of the member 104 between positions may require coordinated movement of the seat 132.

In one embodiment, the frame 102 includes at least one beam 158 providing structural support for the exercise bench 100. Depending on the particular application, the beam may include first and second beam portions 160, 162, which can be formed as two or more distinct beam segments joined by weldments and/or as a monolithic beam. In such embodiments, the first beam portion 160 may support the backrest 130. The second beam portion 162 may support the seat 132. As shown, the post 140 may be engaged (or engageable) with the first beam portion 160 to support the backrest 130 in a desired position. In like manner, the seat post 142 may be engaged (or engageable) with the second beam portion 162 to support the seat 132 in a desired position, including but not limited to the first and second positions discussed herein. As described more fully below, the post 140 may be movably (e.g., slidably) coupled to the first beam portion 160 to alter the position of the backrest 130 relative thereto. Similarly, the seat post 142 may be movably coupled to the second beam portion 162 to alter the position of the seat 132 relative thereto.

The beam 158 may be sized, shaped, and/or positioned to support the exercise bench 100 in its operating and storage positions. In one embodiment, when the exercise bench 100 is positioned into its operating position, the beam 158 may run or extend generally horizontally in reference to a support surface. Similarly, when the exercise bench 100 is positioned into its storage position, the beam 158 may run or extend generally vertically in reference to the support surface. As described herein, the terms "generally horizontally" and "generally vertically" encompass embodiments in which the beam 158 is not truly horizontal or vertical relative to the support surface, such as embodiments in which the beam 158 includes both vertical and horizontal components. For example, as shown in at least FIG. 1, when the exercise bench 100 is positioned in its operating position, the beam 158 may include both horizontal and vertical components, but the beam 158 runs predominantly in a horizontal manner. In like manner, as shown in at least FIG. 9, when the exercise bench 100 is positioned in its storage position, the beam 158 may include both vertical and horizontal components, but the beam 158 runs predominantly in a vertical manner.

The first and second beam portions 160, 162 may include many different configurations. For example, and without limitation, the first and second beam portions 160, 162 may be elongate members each including proximal and distal ends 164, 166. The proximal ends 164 of the first and second beam portions 160, 162 may be coupled together, such as monolithically formed together. In one embodiment, the first and second beam portions 160, 162 may be positioned with a slight bend therebetween. For example, the first and second beam portions 160, 162 may together form an arcuate shape that is curved convexly away from the support surface. In such embodiments, the common pivot axis 144 may be positioned adjacent (e.g., above) the apex of the curved shape, such as proximate the proximal ends 164 of the first and second beam portions 160, 162. In each embodiment described herein, the first and second beam portions 160, 162 may be sized and shaped to allow movement of the exercise bench 100 between its operating and storage positions. For instance, the first beam portion 160 may be sized and shaped to allow the backrest 130 to be positioned in the plurality of positions discussed above. Similarly, the second beam portion 162 may be sized and shaped to allow the seat 132 to be positioned in at least its first and second positions.

Depending on the particular application, the frame 102 may include two or more floor supports that support the exercise bench 100 in at least its operating position. In such embodiments, the beam 158 may be operatively coupled to the floor supports. In one embodiment, the frame 102 may include a first floor support 180 coupled to the first beam portion 160 (e.g., to the distal end 166 of the first beam portion 160), and a second floor support 182 coupled to the second beam portion 162 (e.g., to the distal end 166 of the second beam portion 162). In such embodiments, the first and second floor supports 180, 182 may support the front (or head) and rear (or base) of the exercise bench 100, respectively. In one embodiment, one of the floor supports 180, 182 (e.g., the second floor support 182) may be arranged to support the exercise bench 100 in an upright storage position in combination with the member 104, as described below. As shown, each of the first and second floor supports 180, 182 may include a pair of terminal ends 184. In such embodiments, the terminal ends 184 of the first and second floor supports 180, 182 may engage the support surface to support the exercise bench 100 in its operating and/or storage positions. The terminal ends 184 of the second floor support 182 may engage the support surface when the exercise bench 100 is positioned in both its operating position (see FIG. 1) and its storage position (see FIG. 9).

Each floor support may include a width sufficient to laterally support the exercise bench 100 and inhibit or limit tipping of the exercise bench 100 to either side. Additionally, the first and second floor supports 180, 182 may be spaced along the length of the exercise bench 100 to inhibit or limit tipping of the exercise bench 100 to the front or rear. As shown, each floor support may be sized and shaped (e.g., U-shaped, T-shaped, etc.) to provide a desired aesthetic or functional characteristic. For example, the second floor support 182 may be shaped to space the seat 132 (and the backrest 130) away from the support surface, such as to provide a comfortable seating position. The shape of the second floor support 182 may also provide a stable base in combination with the movable member 104 to support the exercise bench 100 in an upright storage position, as explained below. For example, once the member 104 is moved to its second position, the exercise machine may be tilted on end to engage the second floor support 182 (e.g., the terminal ends 184 of the second floor support 182) and the member 104 against the support surface (see FIG. 9). In one embodiment, the member 104 may form a triangular base 120 or a tripod-type support structure in combination with the terminal ends 184 of the second floor support 182 (see FIG. 6). As described herein, the portions of the second floor support 182 and the member 104 contacting the support surface may define an area 186 therebetween (see FIG. 6). Depending on the particular application, the area 186 may be triangular, quadrilateral, or polygonal in shape.

In some embodiments, one or more support pads may be coupled to the floor supports 180, 182 and/or the member 104 for engagement with the support surface. For example, the first and second floor supports 180, 182 may include two or more first support pads 190 positioned to engage the support surface when the exercise bench 100 is in its operating position. A second support pad 192 may be coupled to the member 104 (e.g., to the bottom of the member 104) to engage the support surface when the member 104 is in its second position and the exercise bench 100 is tilted on end. In such embodiments, the area 186 may be defined between the structures of the second floor support 182 and the member 104 contacting the support surface. Each support pad 190, 192 may be a rubber bumper or similar type support. In some embodiments, the support pads 190, 192 may be adjustable to support the exercise bench 100 on an uneven or unlevel support surface.

In one embodiment, the size and shape of the exercise bench 100 may limit tipping of the exercise bench 100 when positioned for storage, such as when positioned upright in its storage position. For example, the geometry of the frame 102 (e.g., the geometry of the first and second beam portions 160, 162) may be such to define a center of gravity of the exercise bench 100 positioned within the lateral extents of the area 186 when the exercise bench 100 is tilted on its end and positioned in an upright storage position. In one example, the first and second beam portions 160, 162 may be located interiorly of the support points of the exercise bench 100 when the exercise bench 100 is positioned in an upright storage position. Such a configuration may limit undesired tipping of the exercise bench 100, such as to limit potential injury or property damage caused by the exercise bench 100 falling from its upright storage position.

The exercise bench 100 may include an adjustment assembly 200 operable to selectively position the member 104 in its first and second positions. As one example, the adjustment assembly 200 may include corresponding engagement features between the frame 102 and the member 104. For instance, the adjustment assembly 200 may include first and second detents 202, 204 operatively associated with the frame 102. In one embodiment, the first and second detents 202, 204 may be defined on a bracket 206 connected to the second beam portion 162. In such embodiments, the member 104 may be pivotably coupled to the bracket 206, such as at the pivot axis 110. Depending on the particular application, the bracket 206 may be positioned at least partially between the seat 132 and the second beam portion 162. In some embodiments, the adjustment assembly 200 may extend at least partially within the member 104.

Figure 7:
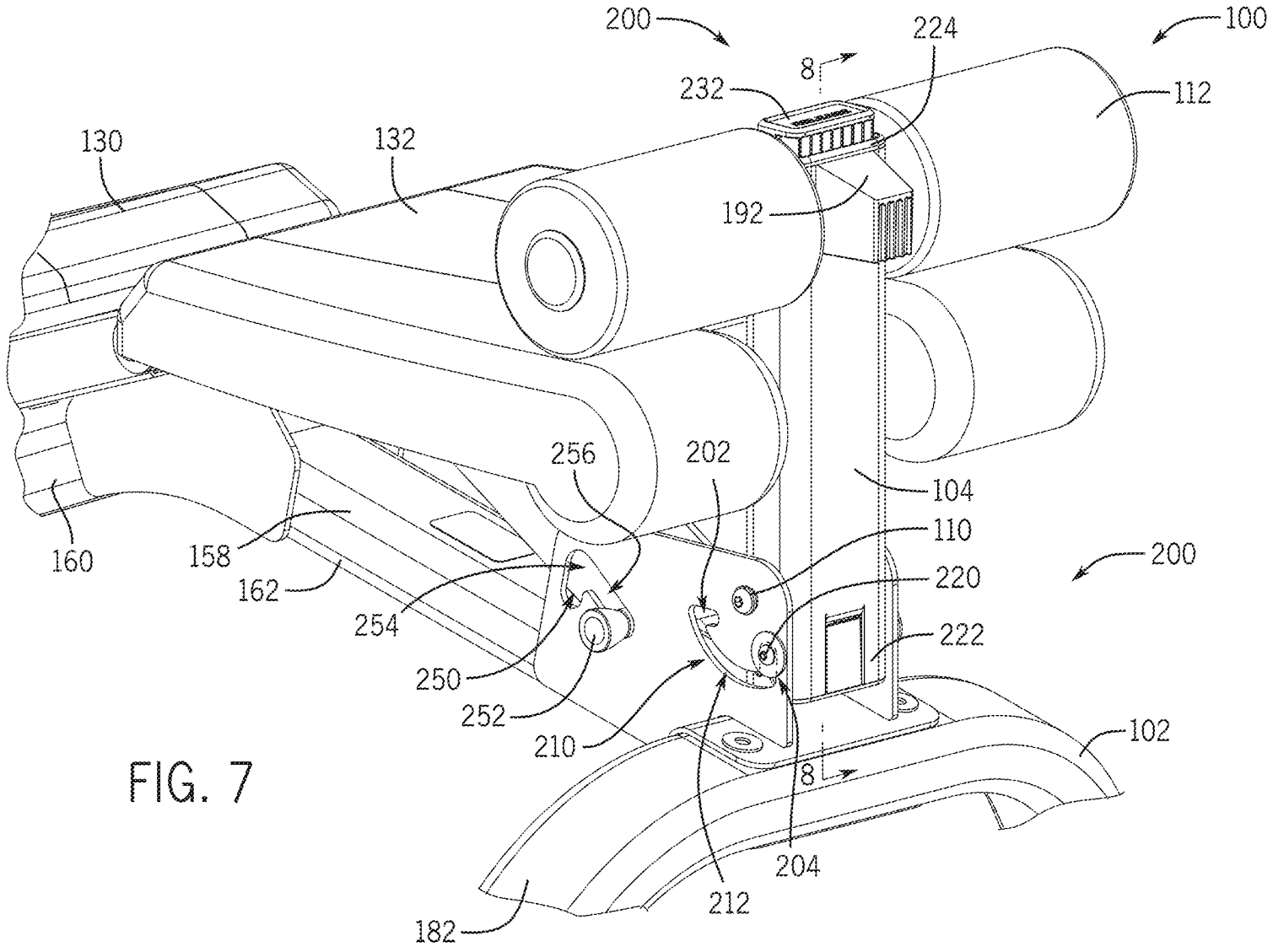
FIG. 7 is an enlarged, fragmentary isometric view of FIG. 6.

As best shown in FIGS. 7 and 8, the first and second detents 202, 204 may be defined as part of a track 210 defined within the beam 158 (e.g., within the bracket 206). The track 210 may include a transition portion 212 defined between the first and second detents 202, 204. In such embodiments, a portion of the member 104 may extend within the track 210 to define the movement of the member 104 relative to the frame 102, as explained below. For example, a portion of the member 104 may extend within the track 210 and traverse from the first detent 202, along the transition portion 212, and into the second detent 204 to move the member 104 from its first position to its second position. Similarly, a portion of the member 104 may extend within the track 210 and traverse from the second detent 204, along the transition portion 212, and into the first detent 202 to move the member 104 from its second position to its first position. As shown, the transition portion 212 may be shaped arcuately between the first and second detents 202, 204 to allow rotation of the member 104 about the pivot axis 110. The first and second detents 202, 204 may extend from, and at an angle to, the transition portion 212 to define hard stops for the first and second positions of the member 104, respectively.

With continued reference to FIGS. 7 and 8, the adjustment assembly 200 may include a pin 220 movably coupled with the member 104 and selectively positioned within the first and second detents 202, 204 to position the member 104 in its first and second positions, respectively. For example, the pin 220 may be slidably coupled with the member 104 to move along a length of the member 104, such as between opposing first and second ends 222, 224 of the member 104. In such embodiments, the first end 222 of the member 104 may be pivotably coupled to the frame 102 (e.g., to the bracket 206 at the pivot axis 110). The ankle pad 112 may be operatively coupled with the second end 224 of the member 104. The pin 220 may be movably coupled to the member 104 between the pivot axis 110 and a terminal end (e.g., the first end 222) of the member 104.

As described herein, the pin 220 may move along the track 210 as the member 104 moves relative to the frame 102. For example, as the member 104 rotates about the pivot axis 110, the pin 220 may move along the transition portion 212 between the first and second detents 202, 204. Once positioned proximate either the first detent 202 or the second detent 204, the pin 220 may move along a length of the member 104 and into the detent. For example, once positioned proximate the first detent 202, the pin 220 may move along a length of the member 104 towards the pivot axis 110 and into the first detent 202. Similarly, once positioned proximate the second detent 204, the pin 220 may move along a length of the member 104 towards the pivot axis 110 and into the second detent 204. To transition the member 104 between positions, the pin 220 may be moved out of the respective detent and into the transition portion 212 of the track 210. For instance, to transition the member 104 from its first position, the pin 220 may be moved along a length of the member 104 and away from the pivot axis 110 to disengage the pin 220 from the first detent 202 and position the pin 220 within the transition portion 212 of the track 210. In like manner, to transition the member 104 from its second position, the pin 220 may be moved along a length of the member 104 and away from the pivot axis 110 to disengage the pin 220 from the second detent 204 and position the pin 220 within the transition portion 212 of the track 210. Once the pin 220 is positioned within the transition portion 212 of the track 210, the member 104 may be free to rotate about the pivot axis 110 to move the member 104 between its first and second positions. The examples described above are for illustration purposes only and other configurations are contemplated. For example, the first and second detents 202, 204 may be arranged such that the pin 220 is moved towards the pivot axis 110 to disengage the pin 220 from the detents (see FIG. 12-15).

Figure 15:
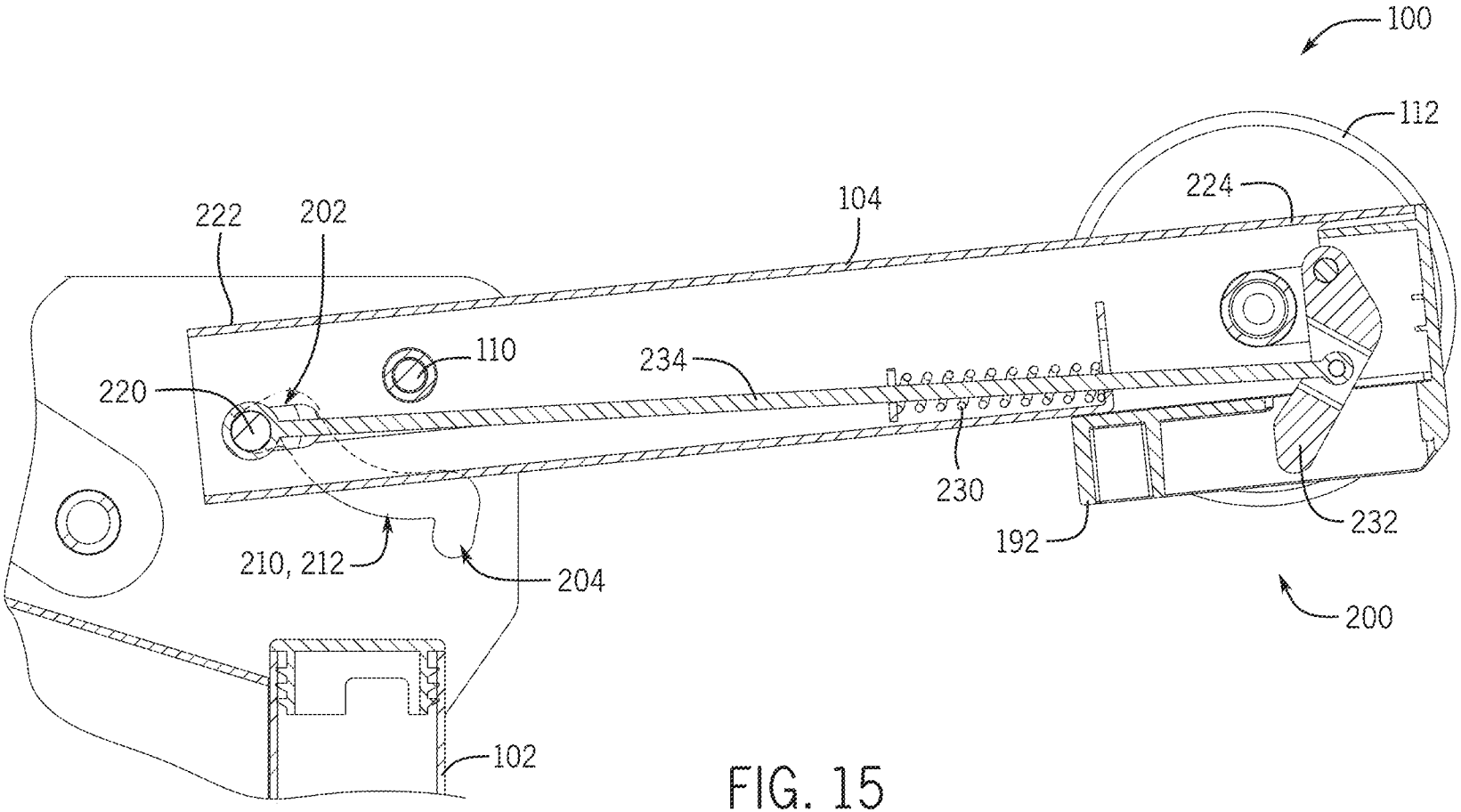
FIG. 15 is a cross-sectional view of another adjustment assembly operable to move a movable member of the exercise bench between first and second positions and taken along line 15-15 of FIG. 14.
Figure 16:
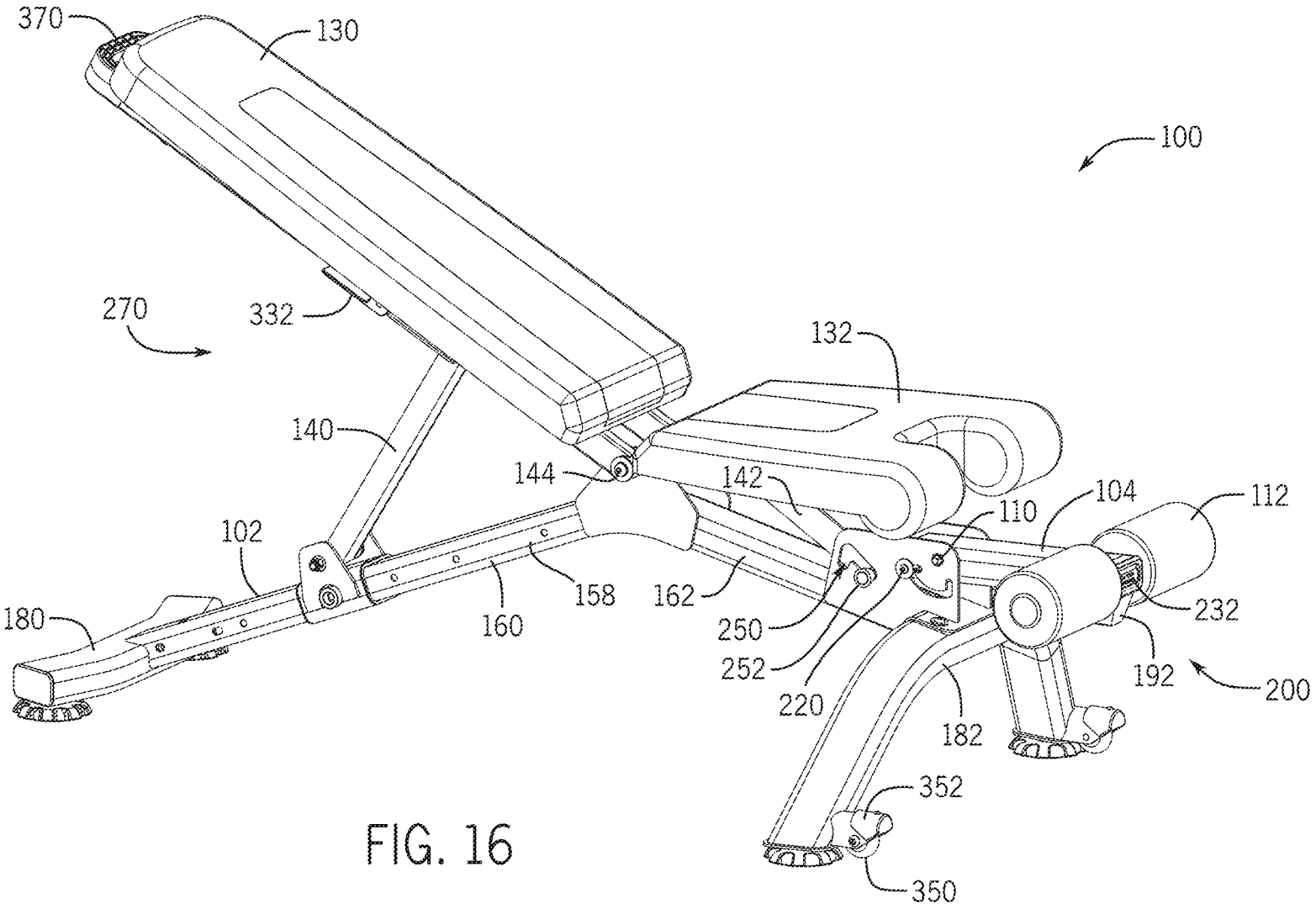
FIG. 16 is an isometric view of an additional exercise bench.
Figure 17:
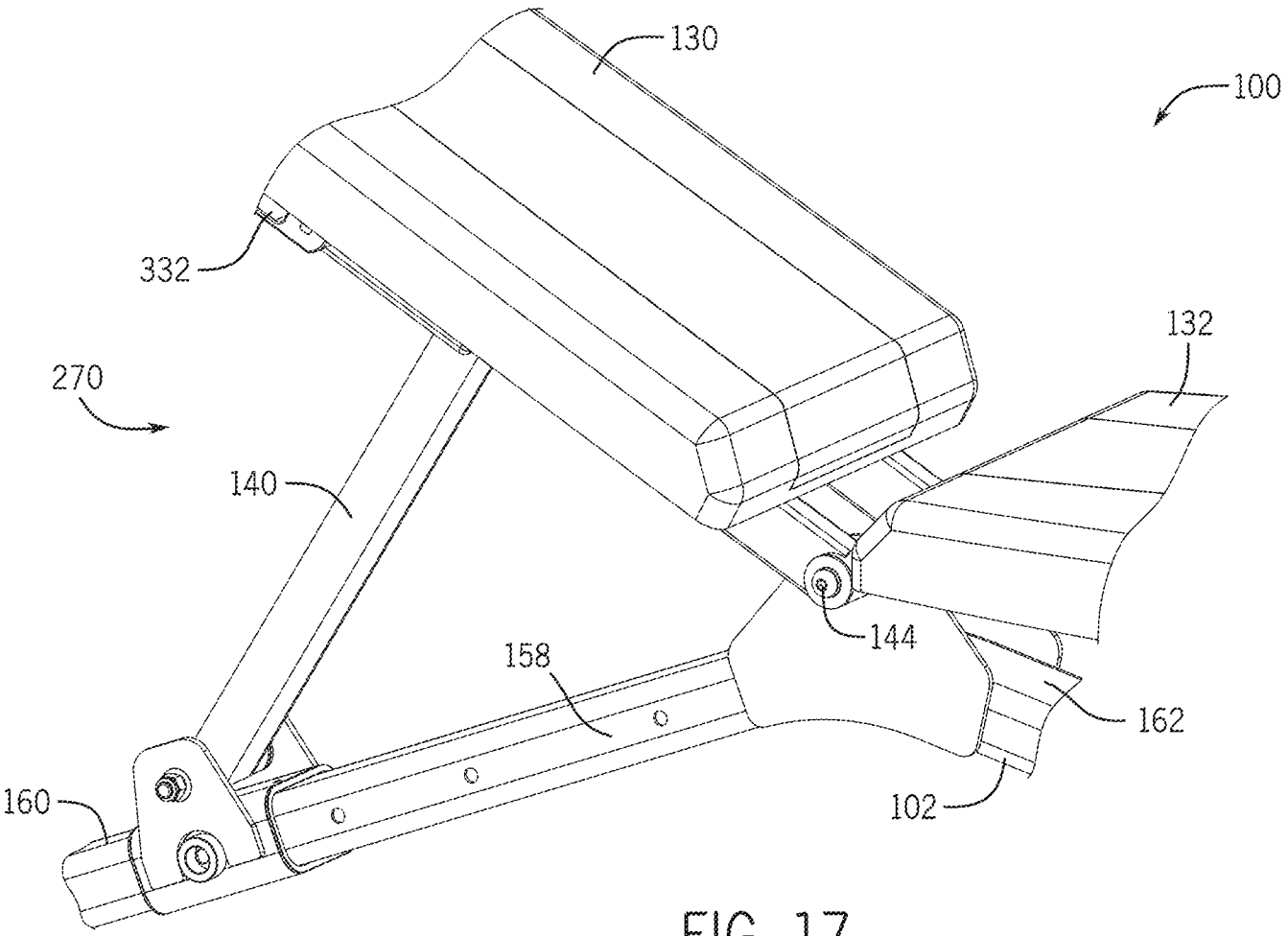
FIG. 17 is an enlarged, fragmentary isometric view of the exercise bench of FIG. 16.

In some embodiments, the pin 220 may be spring-actuated to bias the pin 220 into the first detent 202, into the second detent 204, or into both the first and second detents 202, 204. For example, as shown in FIGS. 8 and 15, the adjustment assembly 200 may include a spring 230 coupled with the pin 220 to bias the pin 220 towards or away from the pivot axis 110. For example, the spring 230 may be arranged such that when the pin 220 is positioned proximate the first detent 202 or the second detent 204, the spring 230 may urge the pin 220 to engage (such as automatically engage) the detent. In this manner, as the member 104 is rotated about the pivot axis 110 towards either its first position or its second position, the pin 220 may automatically seat within the first detent 202 or within the second detent 204, respectively, under the bias of the spring 230. This may also provide a positive locking of the member 104 into its first and second positions. In such embodiments, the member 104 may be moved relative to the frame 102 only upon positive release of the pin 220 from the first and second detents 202, 204.

In some embodiments, the adjustment assembly 200 may include an actuator 232 operable to release the pin 220 from the first and second detents 202, 204. For example, the actuator 232 may be coupled to the pin 220, such as via a rod 234 as shown in FIGS. 8 and 15, to selectively move the pin 220 against the bias of the spring 230. Depending on the particular application, the actuator 232 may be a push plate mechanism (see FIG. 8) or a lever-type mechanism (see FIG. 15). When embodied as a push plate mechanism, the actuator 232 may be positioned at the second end 224 of the member 104 (e.g., adjacent the ankle pad 112). When embodied as a lever-type mechanism, the actuator 232 may be positioned adjacent the second support pad 192, such as concealed behind or within the second support pad 192 (see FIGS. 14 and 15). The examples above are non-limiting, and the actuator 232, as well as the other components of the adjustment assembly 200, may include other suitable configurations.

Similar to the member 104, the seat 132 may be selectively positioned in its first and second positions. As one non-limiting example, the seat post 142 may be at least partially received within a seat track 250 defined within the beam 158, such as within the bracket 206 connected to the second beam portion 162. For example, the seat post 142 may include a pin 252 received at least partially within the seat track 250. In such embodiments, the seat track 250 may be shaped such that movement of the seat post 142 (e.g., the pin 252) within the seat track 250 moves the seat 132 between its first and second positions. Similar to the adjustment assembly 200, the seat track 250 may be shaped to positively engage the seat 132 in its first and second positions. For instance, as best shown in FIG. 7, the seat track 250 may be include an inverted V-shape or U-shape including a first track portion 254 and a second track portion 256 defining the first and second positions of the seat 132, respectively. As shown, the first and second track portions 254, 256 may extend at least partially downward towards the support surface. In such embodiments, when the pin 252 is positioned within either the first track portion 254 or the second track portion 256, at least the weight of the seat 132 may positively position the pin 252 in one track portion and limit movement of the pin 252 into the other track portion.

As described herein, the seat 132 and/or the seat track 250 may be sized and shaped to position the seat 132 in a manner facilitating the positioning of the member 104 into its second position. For example, the seat track 250 may be shaped such that positioning the seat 132 into its second position allows the ankle pad 112 of the member 104 to move by the seat 132. For example, the seat track 250 may be shaped such that the seat 132 is positioned between the frame 102 and the ankle pad 112 when the seat 132 is in its second position and the member 104 is in its second position. In some embodiments, the seat 132 may include a cut-out 260 sized and shaped to at least partially receive the member 104 therein (at least when the member 104 is in its second position).

Similar to the seat 132 and the member 104, the backrest 130 may be selectively positioned as desired. For example, the exercise bench 100 may include a lock mechanism 270 operable to maintain or effectively lock the backrest 130 in a desired angular position. In one embodiment, the lock mechanism 270 includes a releasable latch structure 272. The latch structure 272 may include a plurality of catches 274 and a securement mechanism 276. The securement mechanism 276 may be selectively securable to, such as releasably engageable with, the catches 274 to define discrete positions of the backrest 130 relative to the frame 102. For example, engagement of the securement mechanism 276 with particular catches 274 may define an uppermost position of the backrest 130 (see FIG. 1), an intermediate position of the backrest 130 (see FIGS. 2-5), and a lowermost position of the backrest 130 (see FIG. 6), among others.

The catches 274 and the securement mechanism 276 may take on many suitable configurations. For instance, in one example, the securement mechanism 276 may include a pop pin structure 280 operable to releasably engage corresponding apertures 282 defined within the first beam portion 160 (see FIGS. 1-6). In other examples, the securement mechanism 276 may include a rod or bar 290 releasably secured within indentations 292 defined in the first beam portion 160 (see FIGS. 20-22). In such embodiments, the rod or bar 290 may be slidably coupled to the first beam portion 160, such as within a channel 294 defined within the first beam portion 160. In such embodiments, the indentations 292 may be defined along the length of the channel 294. The rod or bar 290 may be disengaged from the indentations 292 by lifting the rod or bar 290 out of the indentations 292 either manually or via a ramp structure 296 slidably received within the first beam portion 160 (see FIG. 22). For example, actuation of a lever 298 may move the ramp structure 296 within the first beam portion 160 to engage and subsequently lift the rod or bar 290 out of the indentations 292. Once disengaged from the indentations 292, the rod or bar 290 may be free to slide within the channel 294 to raise or lower the backrest 130 relative to the frame 102.

Figure 18:
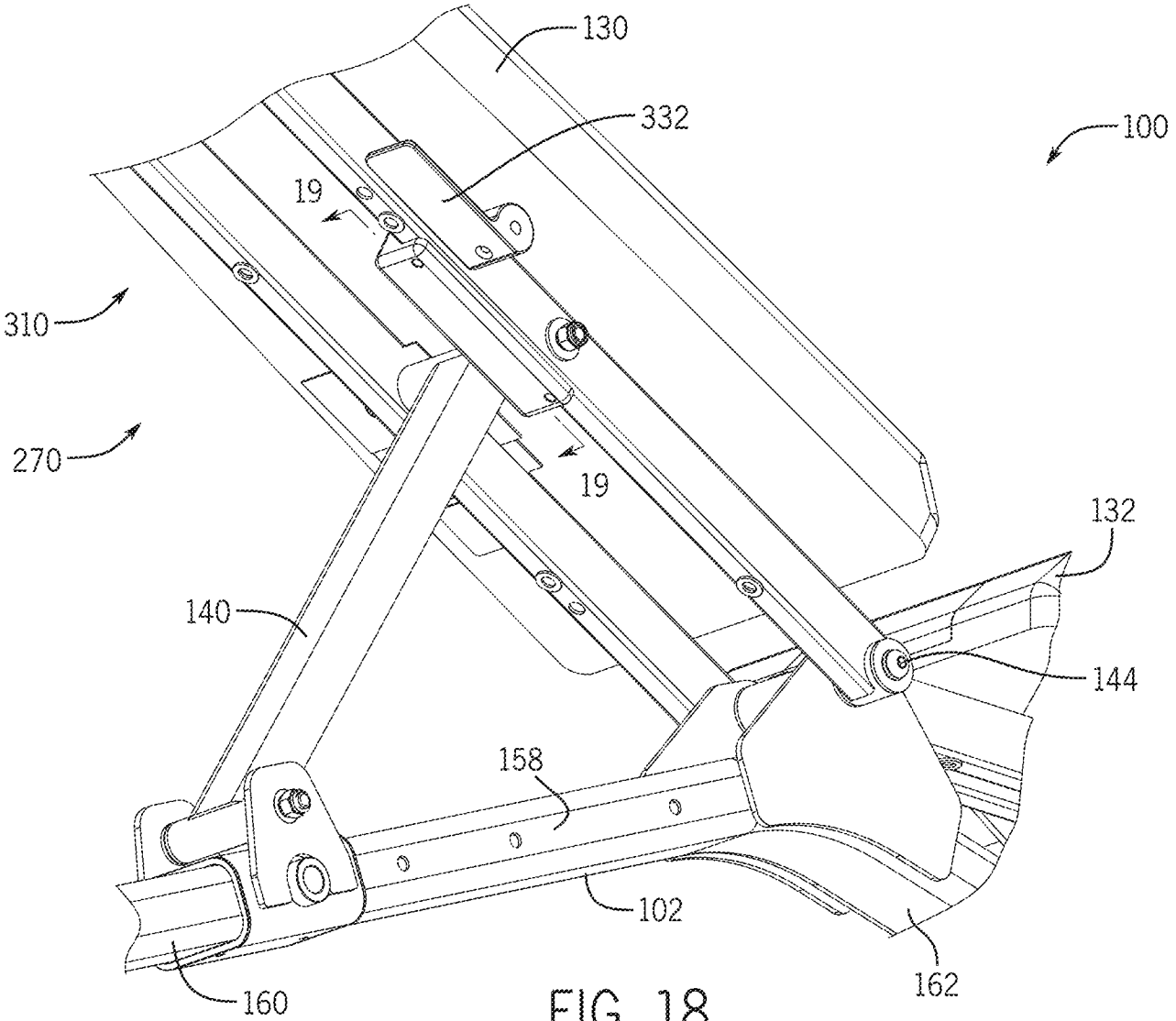
FIG. 18 is another enlarged, fragmentary isometric view of the exercise bench of FIG. 16.
Figure 19:
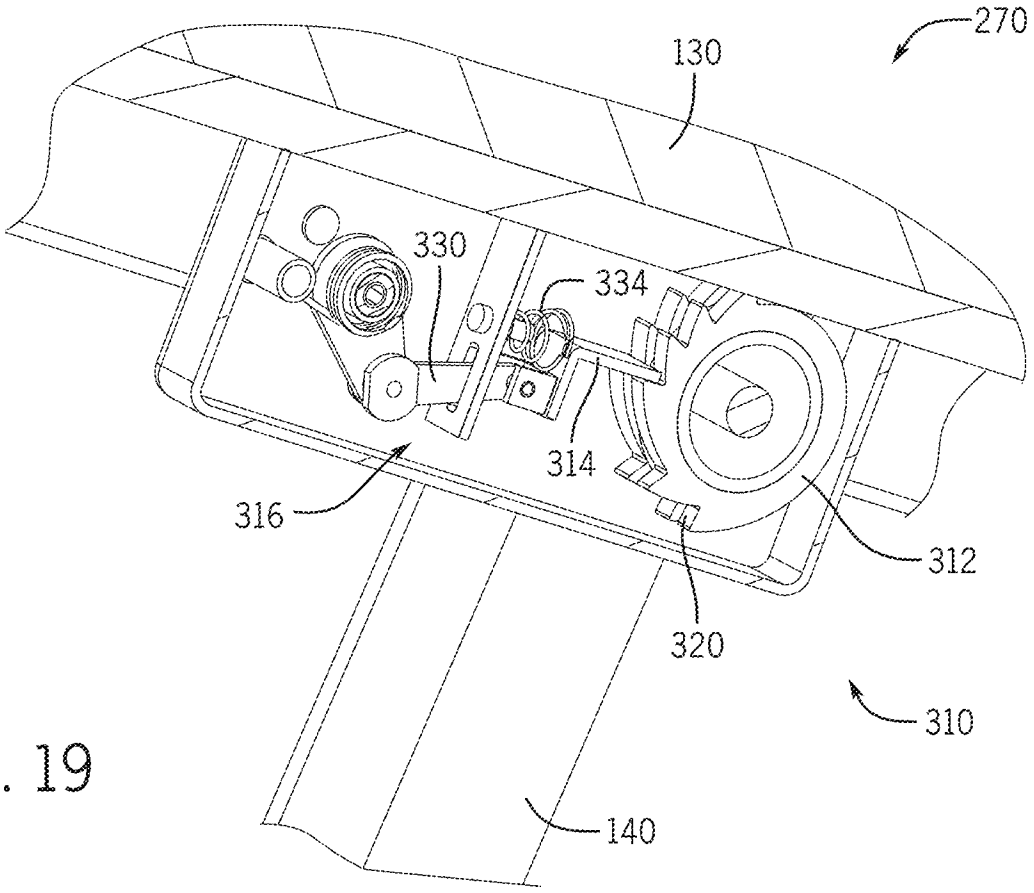
FIG. 19 is a cross-sectional view of a lock mechanism operable to releasably secure the backrest in a desired angular position relative to the frame of the exercise bench and taken along line 19-19 of FIG. 18.
Figure 20:
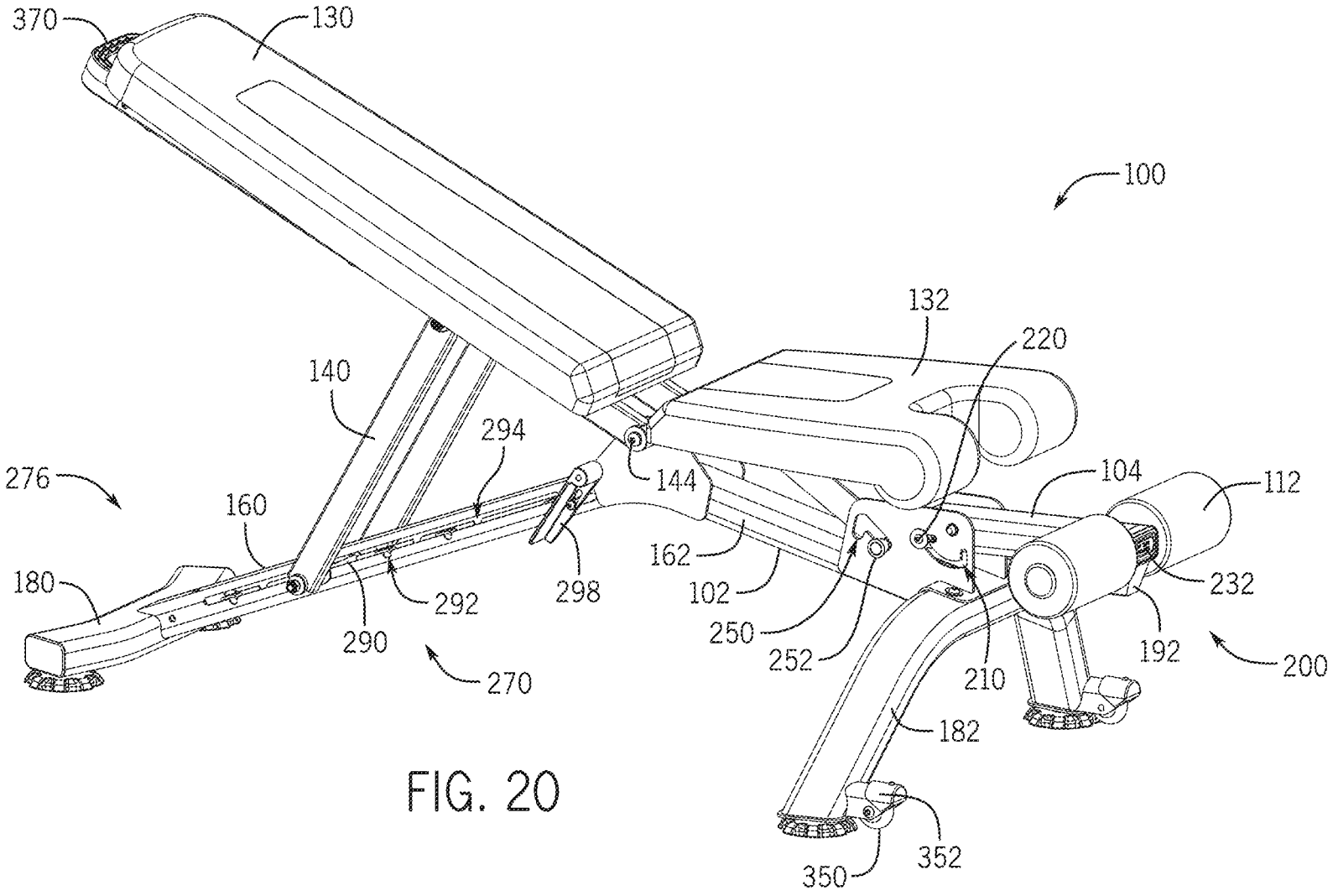
FIG. 20 is an isometric view of an additional exercise bench.
Figure 21:
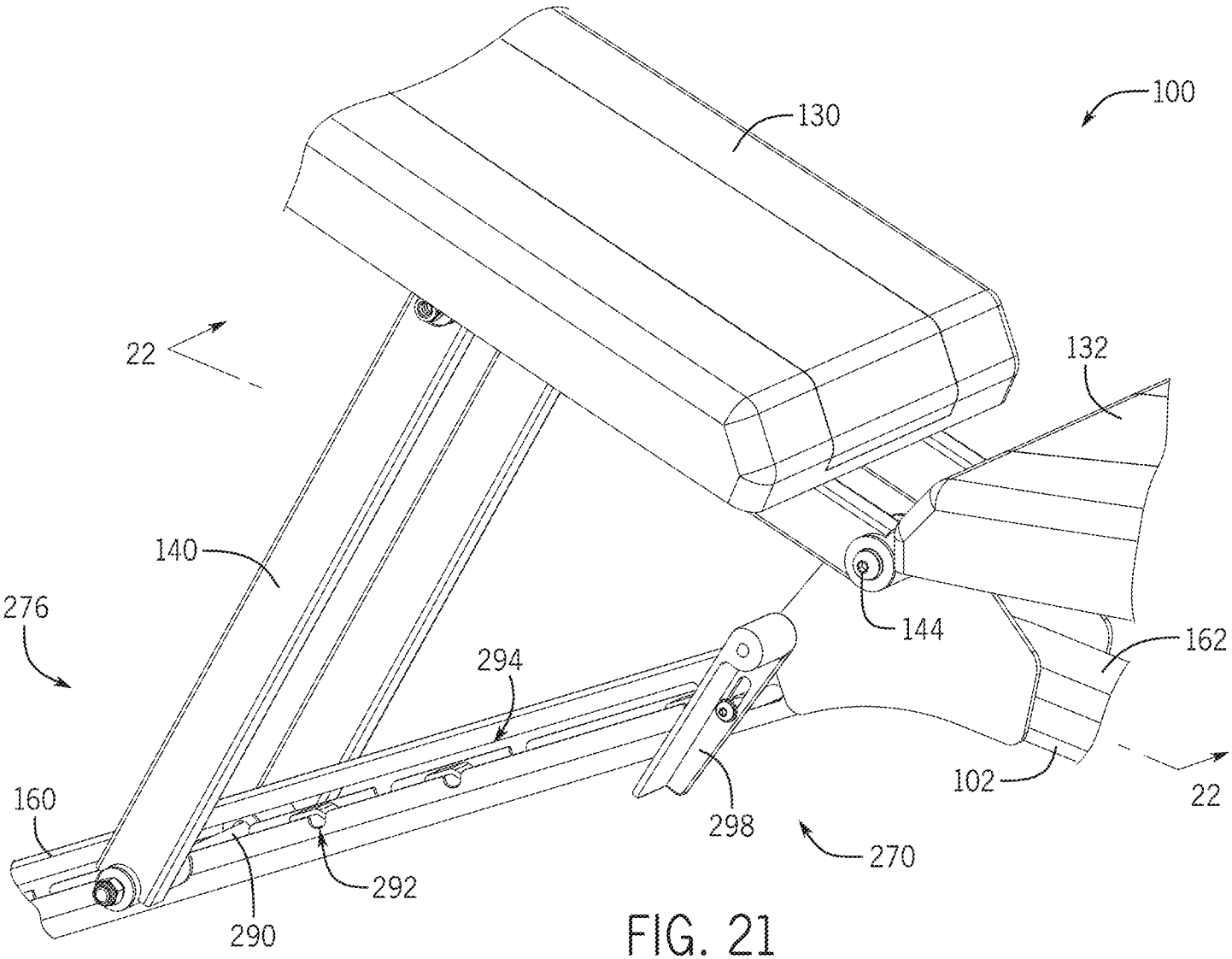
FIG. 21 is an enlarged, fragmentary isometric view of the exercise bench of FIG. 20.
Figure 22:
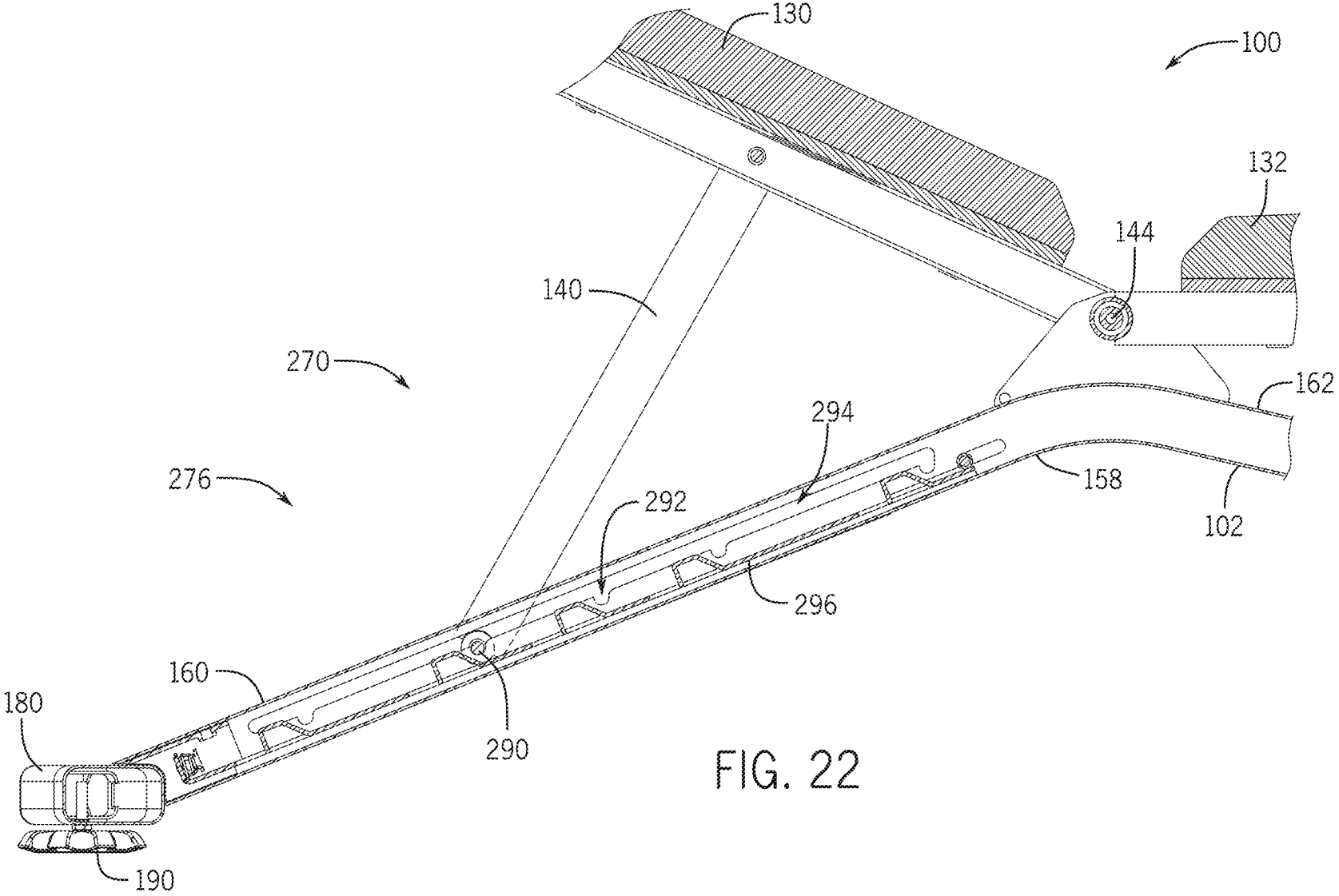
FIG. 22 is a cross-sectional view of the exercise bench of FIG. 20 and taken along line 22-22 of FIG. 21.
Figure 25:
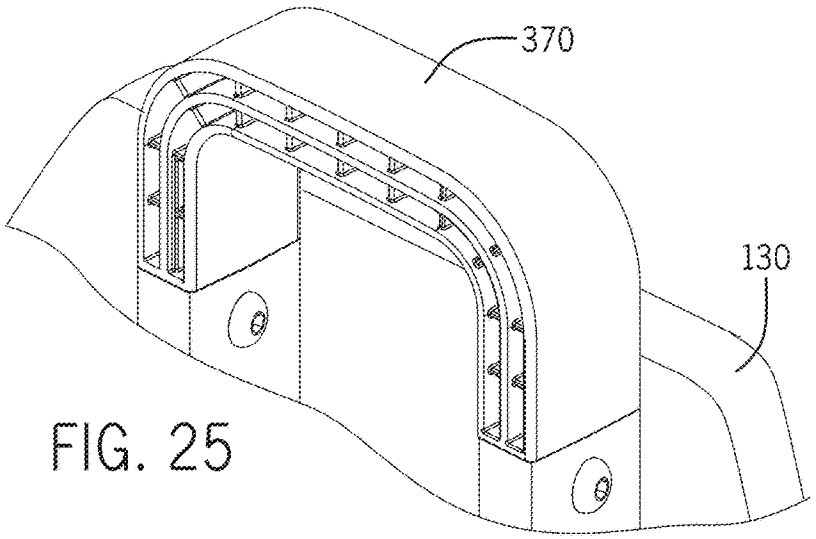
FIGS. 23-26 are fragmentary isometric views of alternative handle structures.
Figure 26:
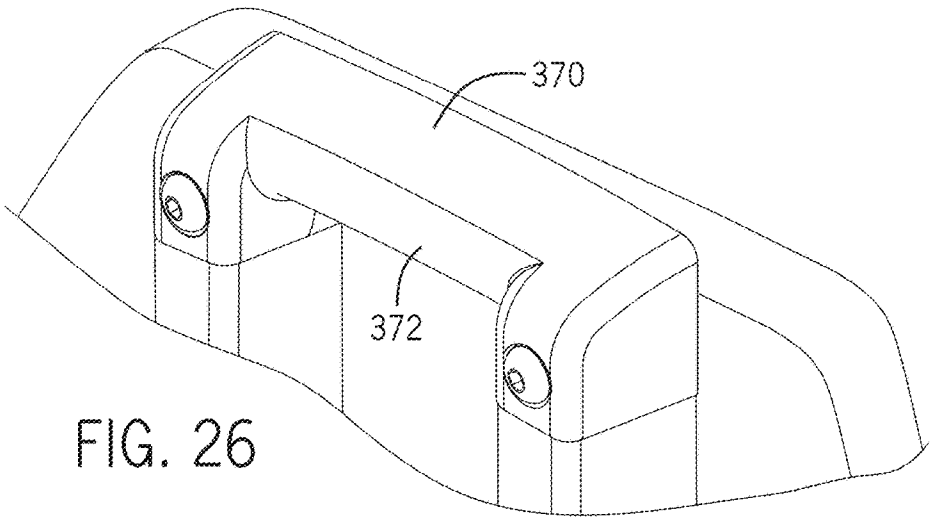
Figure 23:
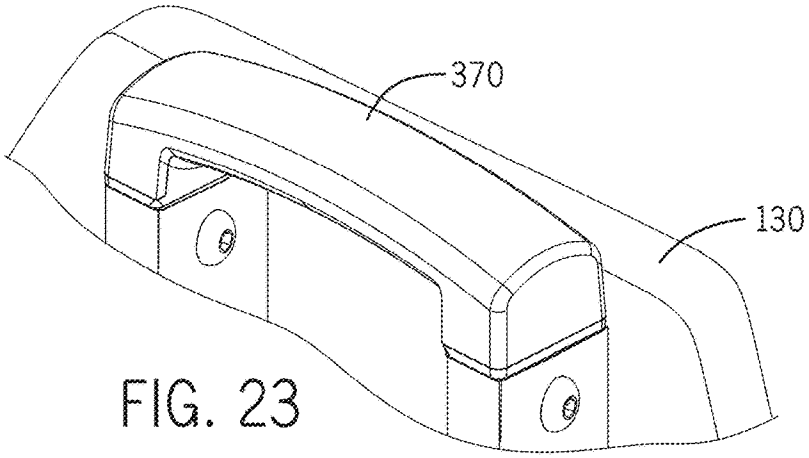
Figure 24:
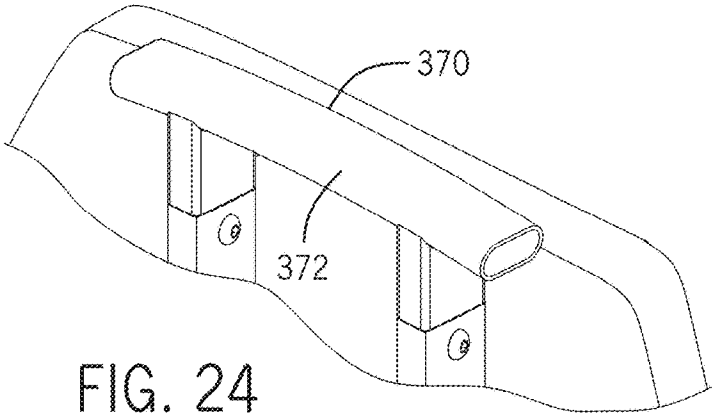
Figure 27:
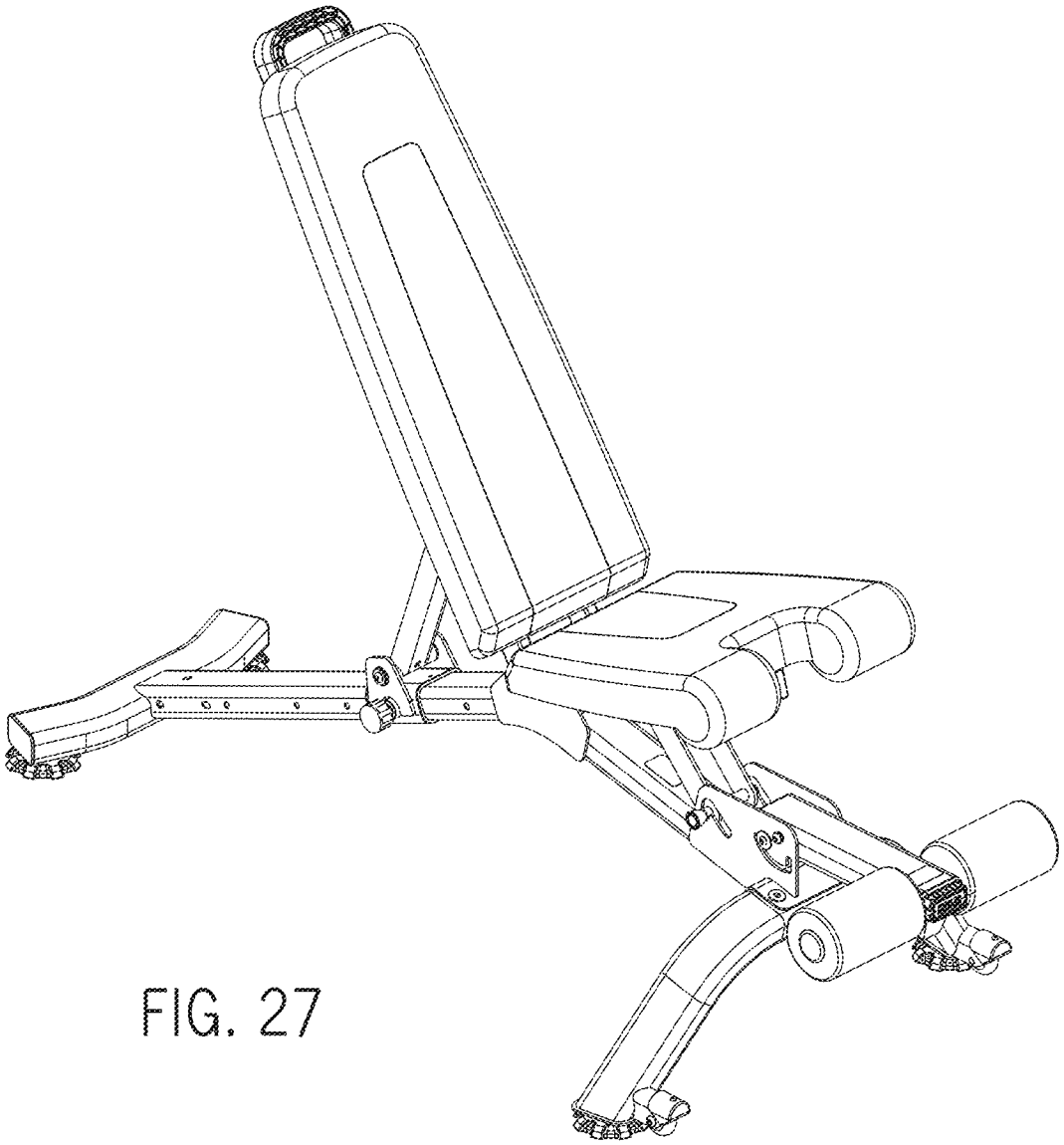
FIGS. 27-34 are design views of an exercise bench in an operating position.
Figure 28:
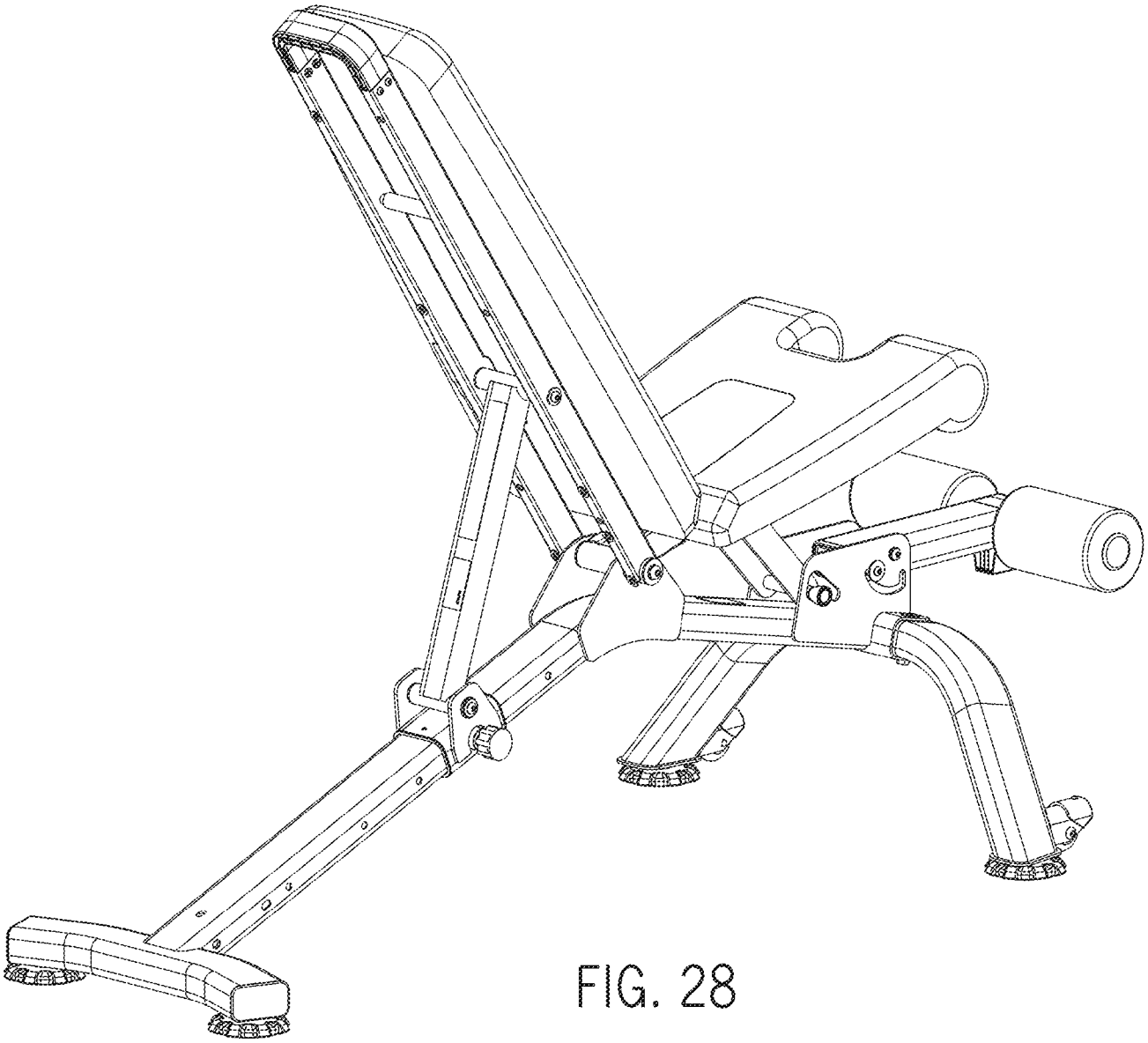
Figure 30:
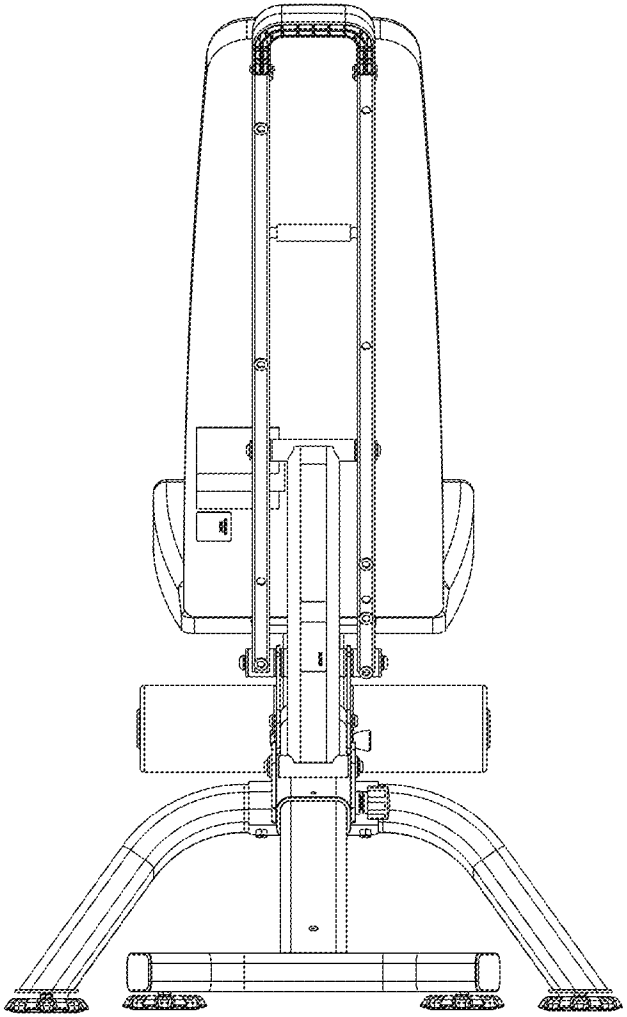
Figure 29:
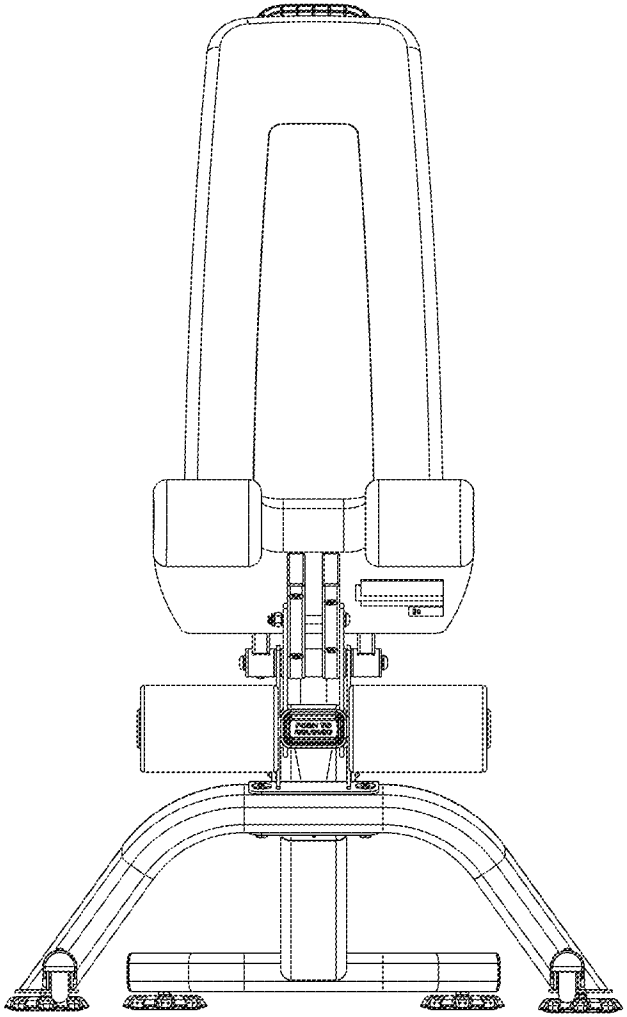
Figure 31:
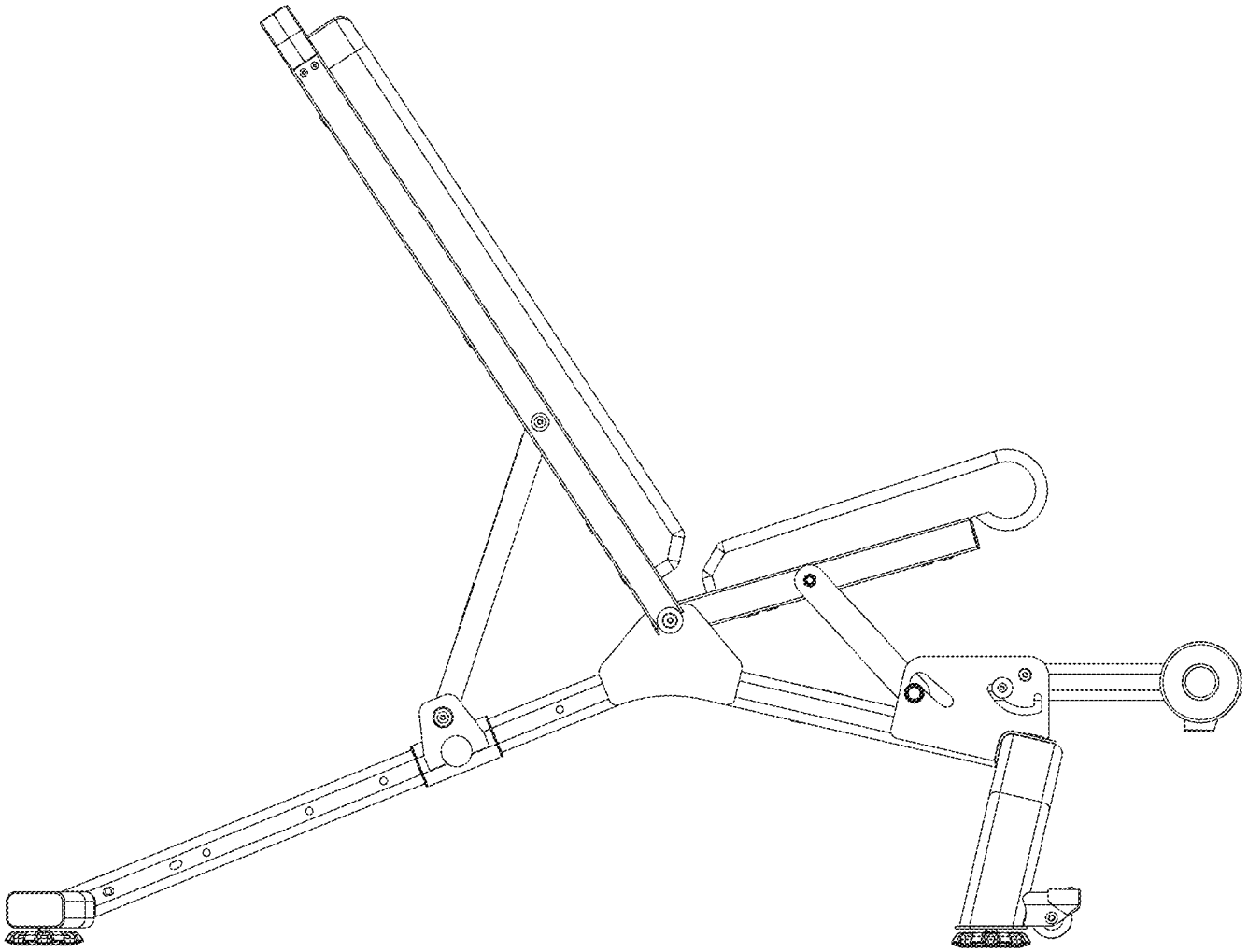
Figure 32:
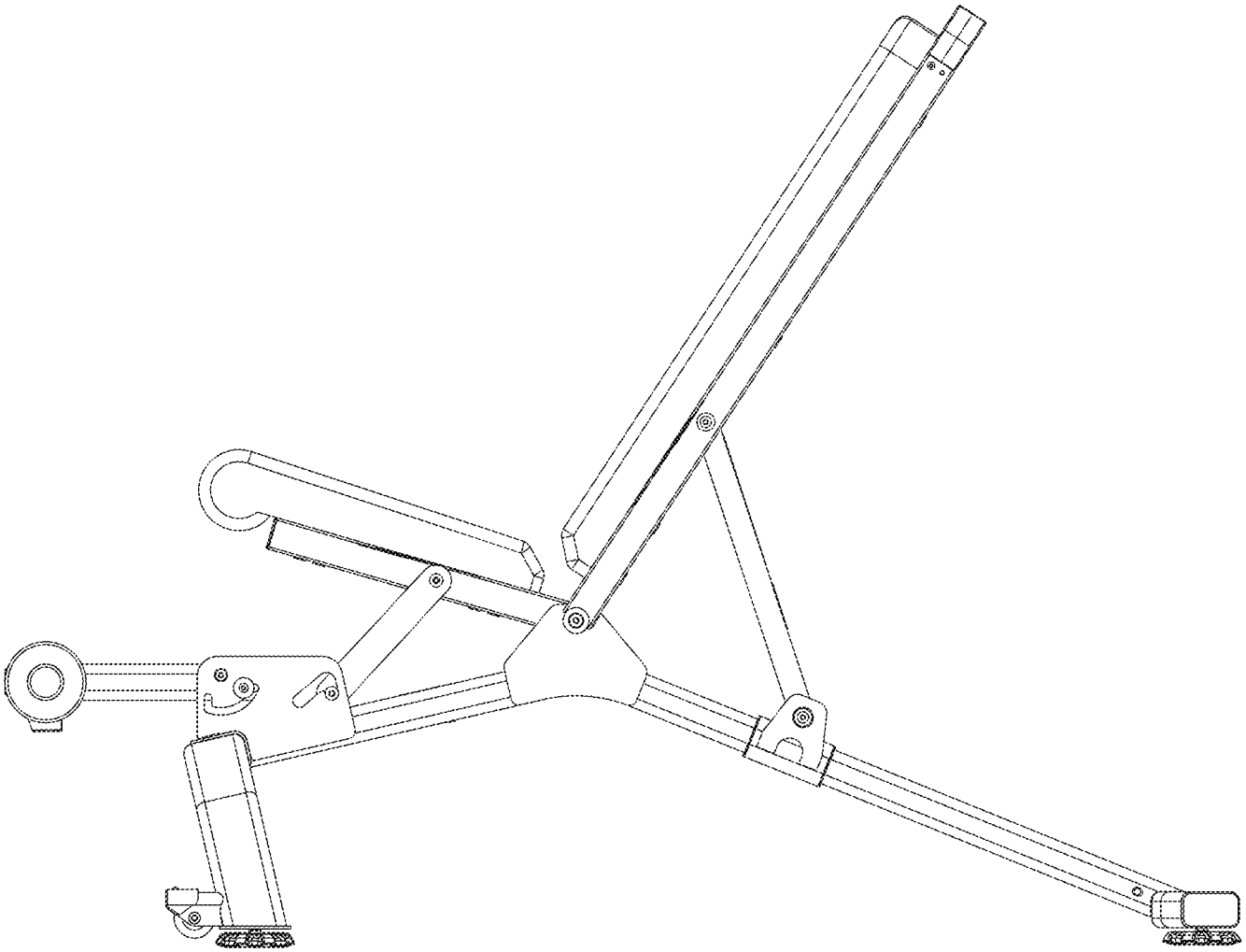
Figure 33:
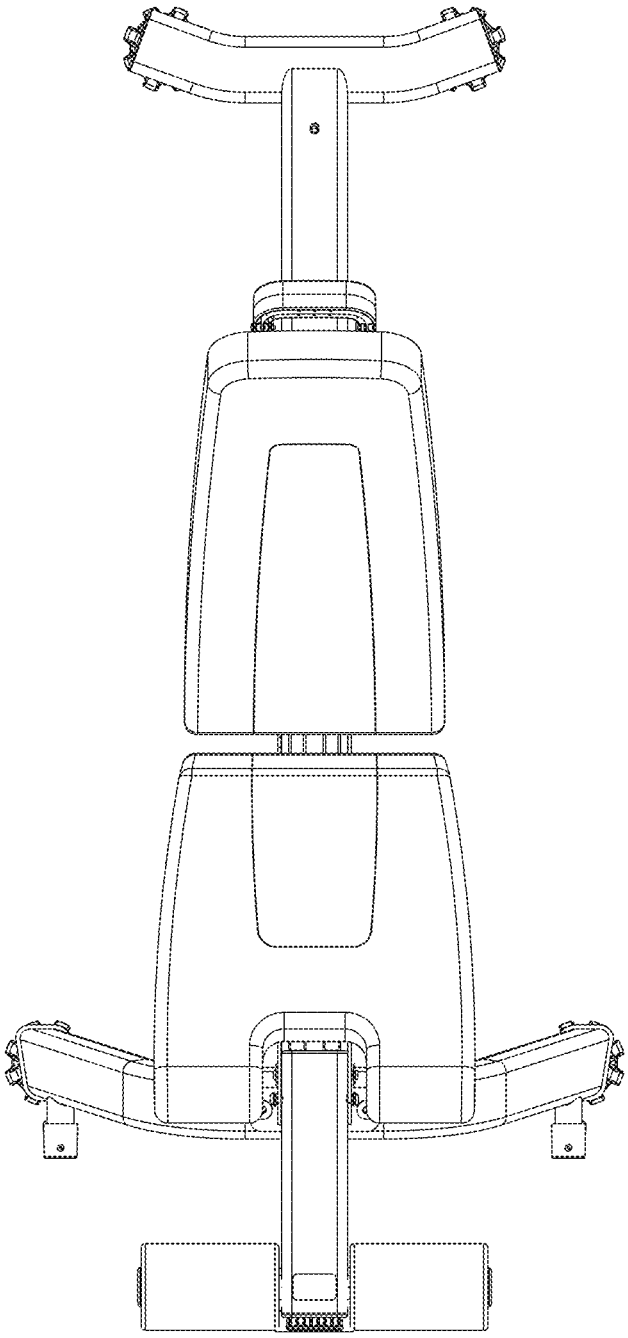
Figure 34:
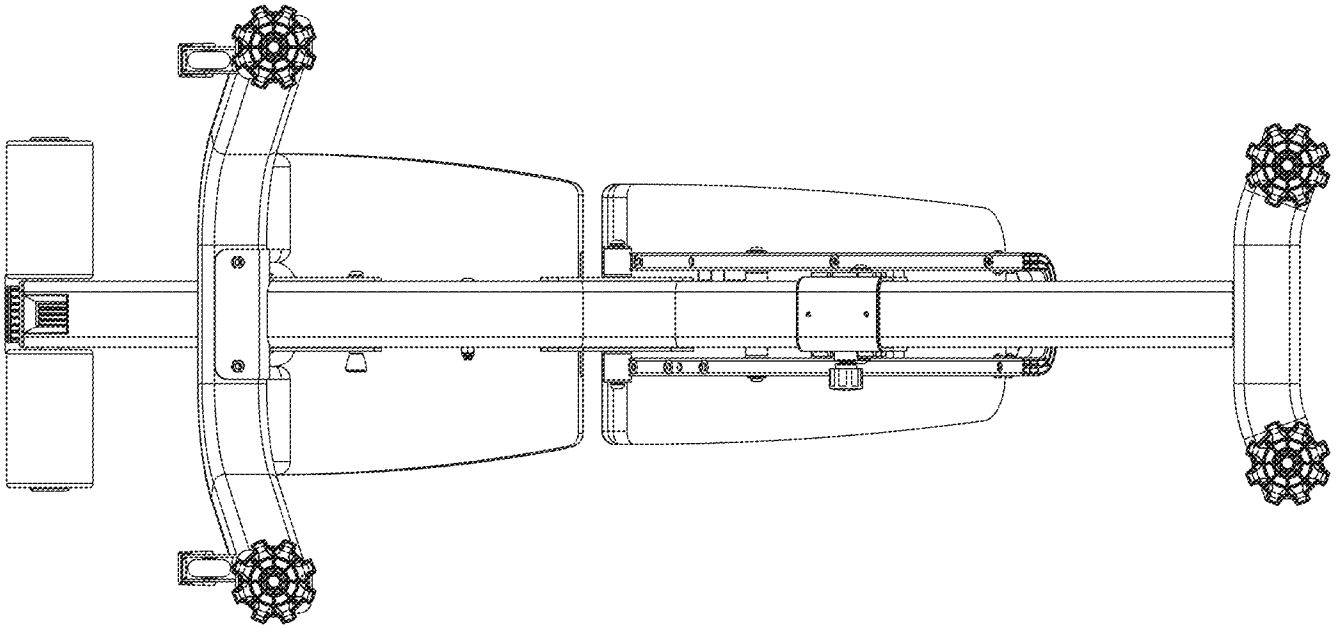
Figure 36:
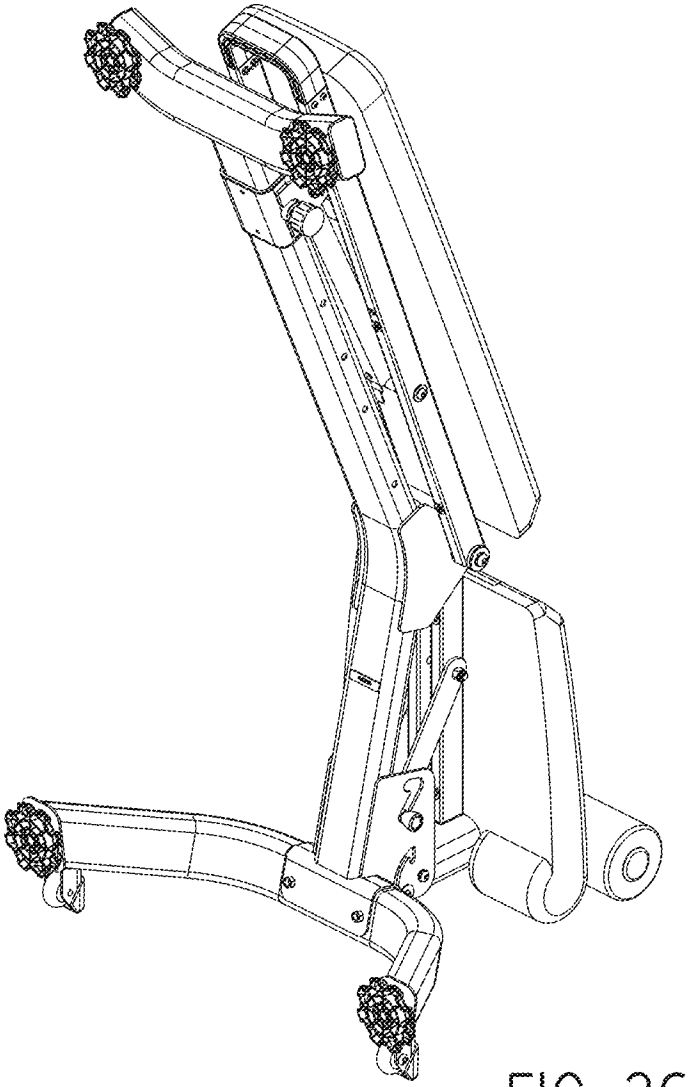
FIGS. 35-42 are design views of an exercise bench in a storage position.
Figure 35:
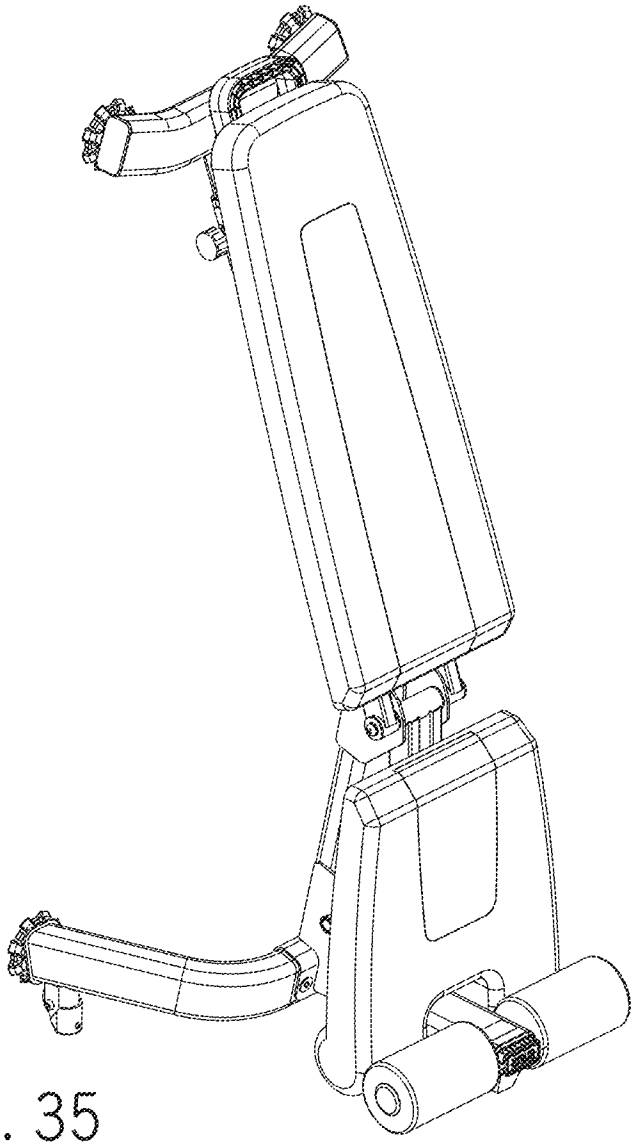
Figure 37:
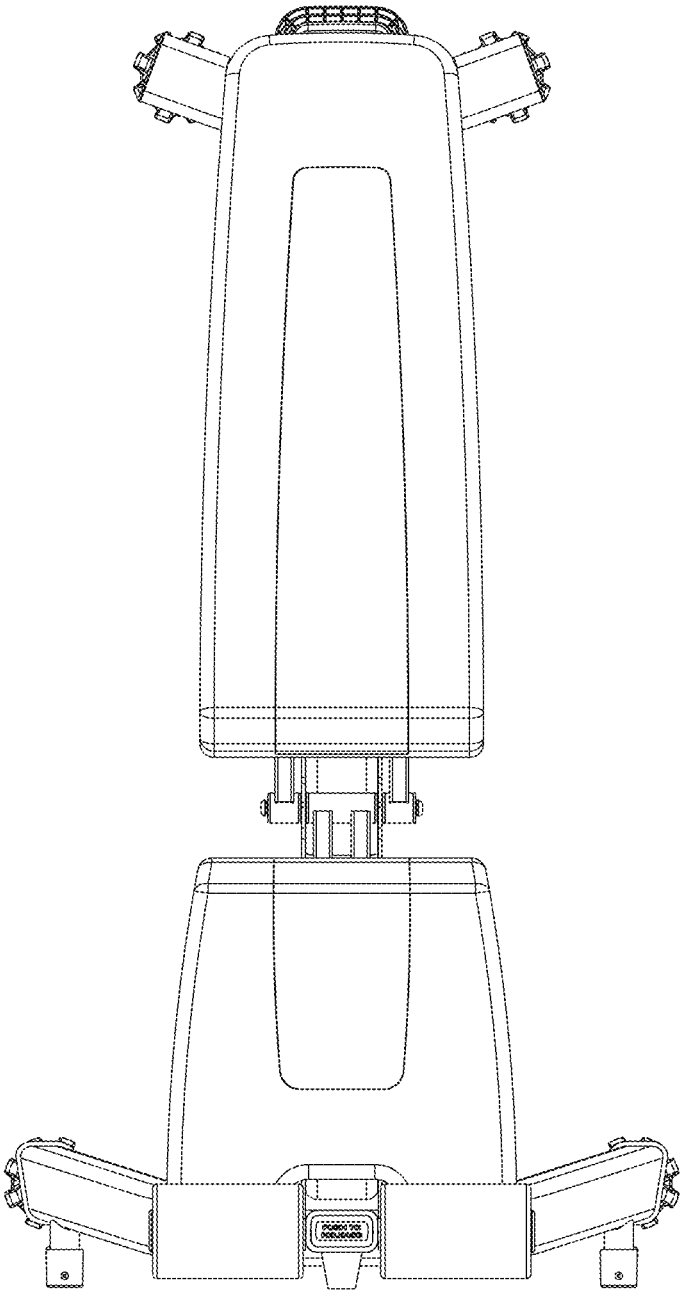
Figure 38:
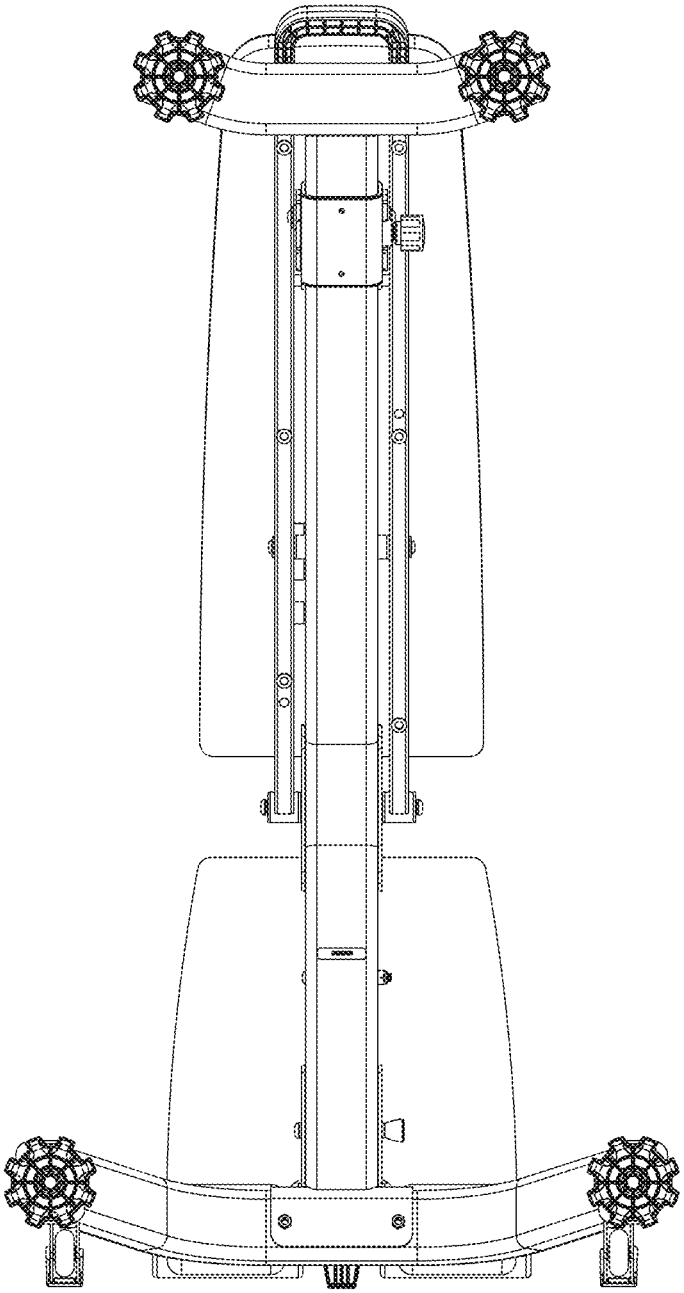
Figure 39:
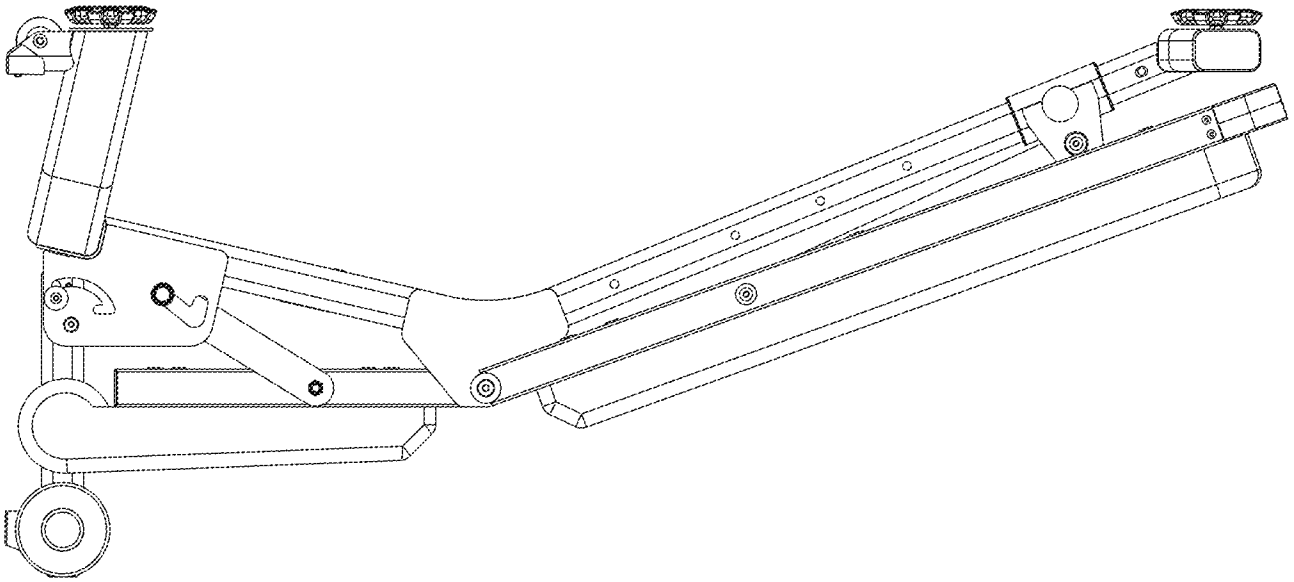
Figure 40:
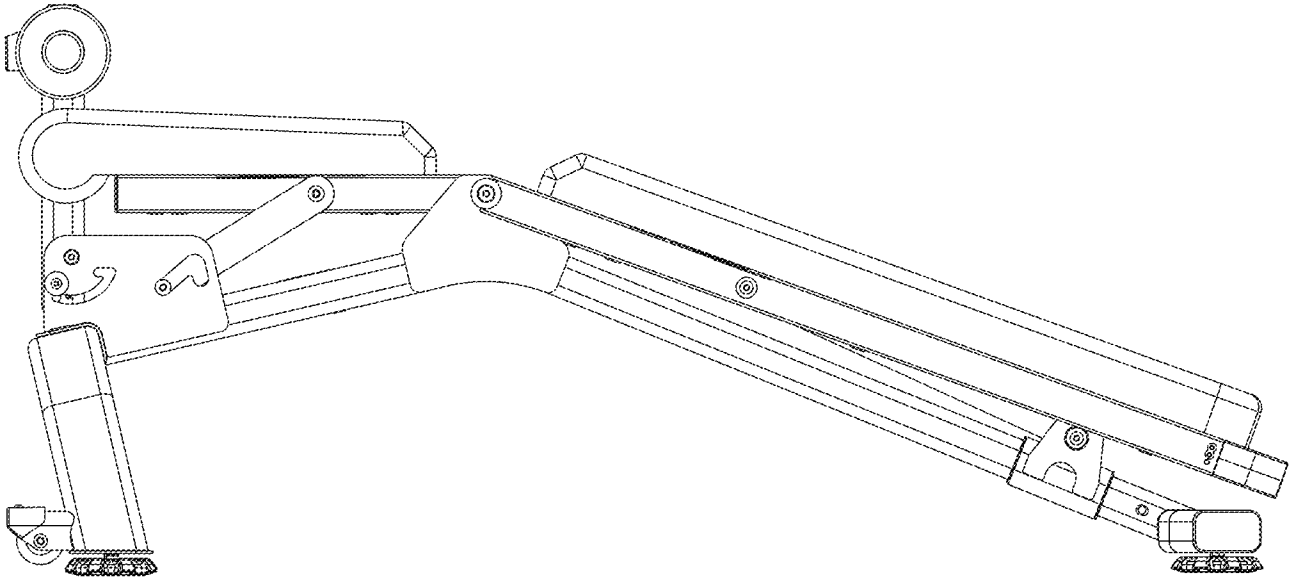
Figure 41:
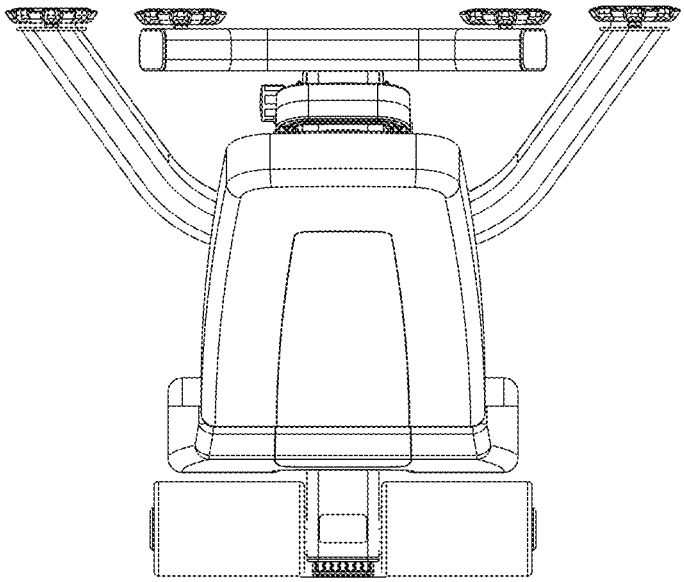
Figure 42:
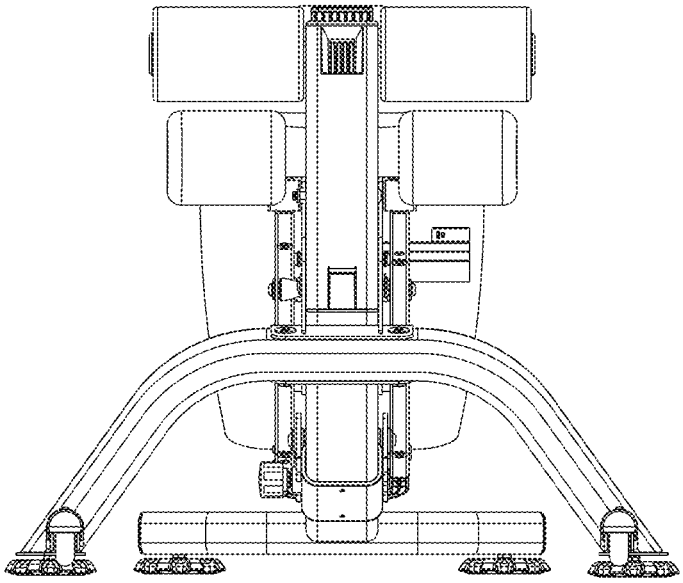

The lock mechanism 270 may take on other suitable configurations. For example, as shown in FIGS. 18 and 19, the lock mechanism 270 may include a ratchet device 310 operable to limit rotation of the post 140 relative to the backrest 130. In one example, the ratchet device 310 includes a ratchet wheel 312, a lock bar 314, and a release assembly 316 (see FIG. 19). The ratchet wheel 312, which may be fixedly connected to the post 140, may include a plurality of ratchet teeth 320 to define the discrete positions of the backrest 130. For example, the lock bar 314 may releasably engage a desired one of the ratchet teeth 320 to define the angular position of the post 140 relative to the backrest 130, and thereby the angular position of the backrest 130 relative to the frame 102. As shown in FIG. 19, the ratchet teeth 320 are directional such that the ratchet wheel 312 may rotate relative to the lock bar 314 in one rotational direction (e.g., counterclockwise in FIG. 19) but is limited from rotating in an opposite rotational direction (e.g., clockwise in FIG. 19). In this manner, the post 140 may be allowed to rotate relative to the backrest 130 in one direction to allow user manipulation of the backrest 130 into an upright position. The directional nature of the ratchet teeth 320, however, may limit or inhibit rotation of the post 140 relative to the backrest 130 in an opposite direction to provide a stable base for a user to perform exercise movements. For example, to lower the backrest 130 from a relative upright position, the lock bar 314 must first be disengaged from the ratchet teeth 320.

The release assembly 316 may be operable to selectively release the lock bar 314 from the ratchet wheel 312. For instance, the release assembly 316 may include a linkage assembly 330 coupled to a lever arm 332 (see FIG. 18) such that selective rotation of the lever arm 332 moves the linkage assembly 330. As shown in FIG. 19, the linkage assembly 330 is connected to the lock bar 314 to selectively disengage the lock bar 314 from the ratchet wheel 312. For example, rotation of the lever arm 332 in one direction may move the linkage assembly 330 in a first manner to disengage the lock bar 314 from the ratchet wheel 312. In like manner, rotation of the lever arm 332 in an opposite direction may move the linkage assembly 330 in a second manner to engage the lock bar 314 with the ratchet wheel 312. In some embodiments, the lock bar 314 may be biased against the ratchet wheel 312. For example, the release assembly 316 may include a spring 334 arranged to bias the lock bar 314 into engagement with the ratchet wheel 312. In such embodiments, the spring 334 may bias the lock bar 314 into a locked engagement with the ratchet wheel 312 absent a directed force from a user disengaging the lock mechanism 270.

Figure 10:
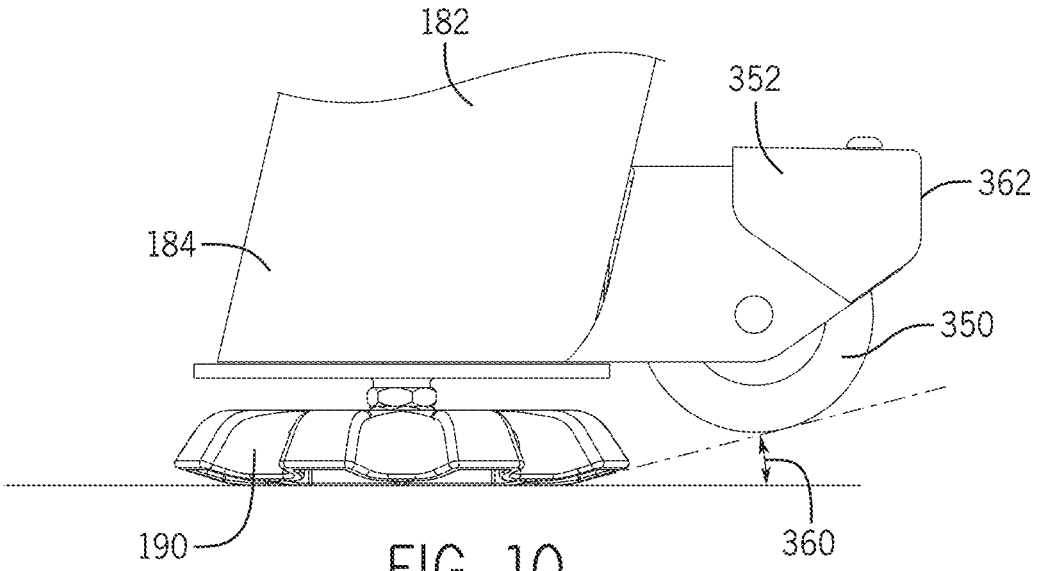
FIG. 10 is an enlarged, fragmentary side elevation view of a wheel housing of the exercise bench.
Figure 11:
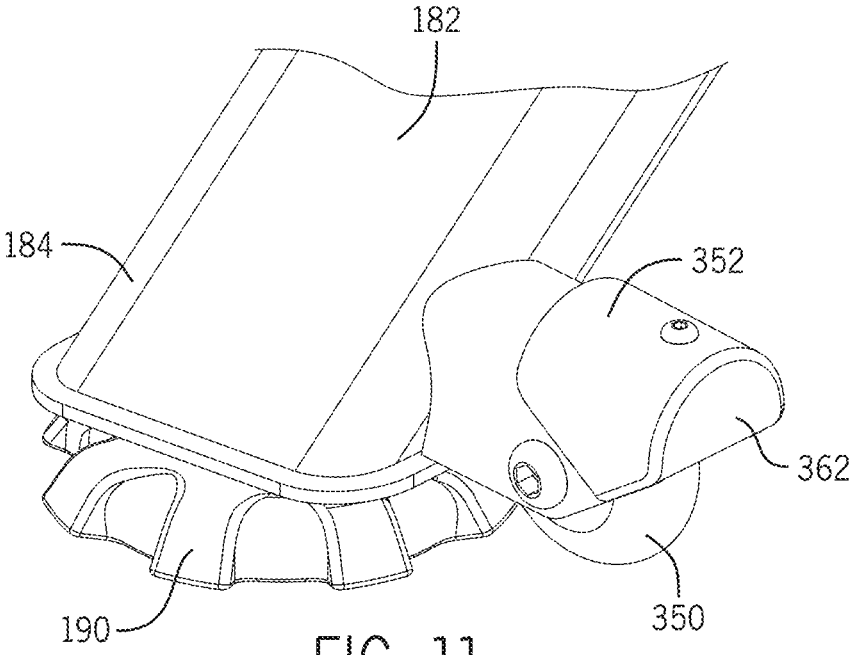
FIG. 11 is an enlarged, fragmentary isometric view of the wheel housing.
Figure 12:
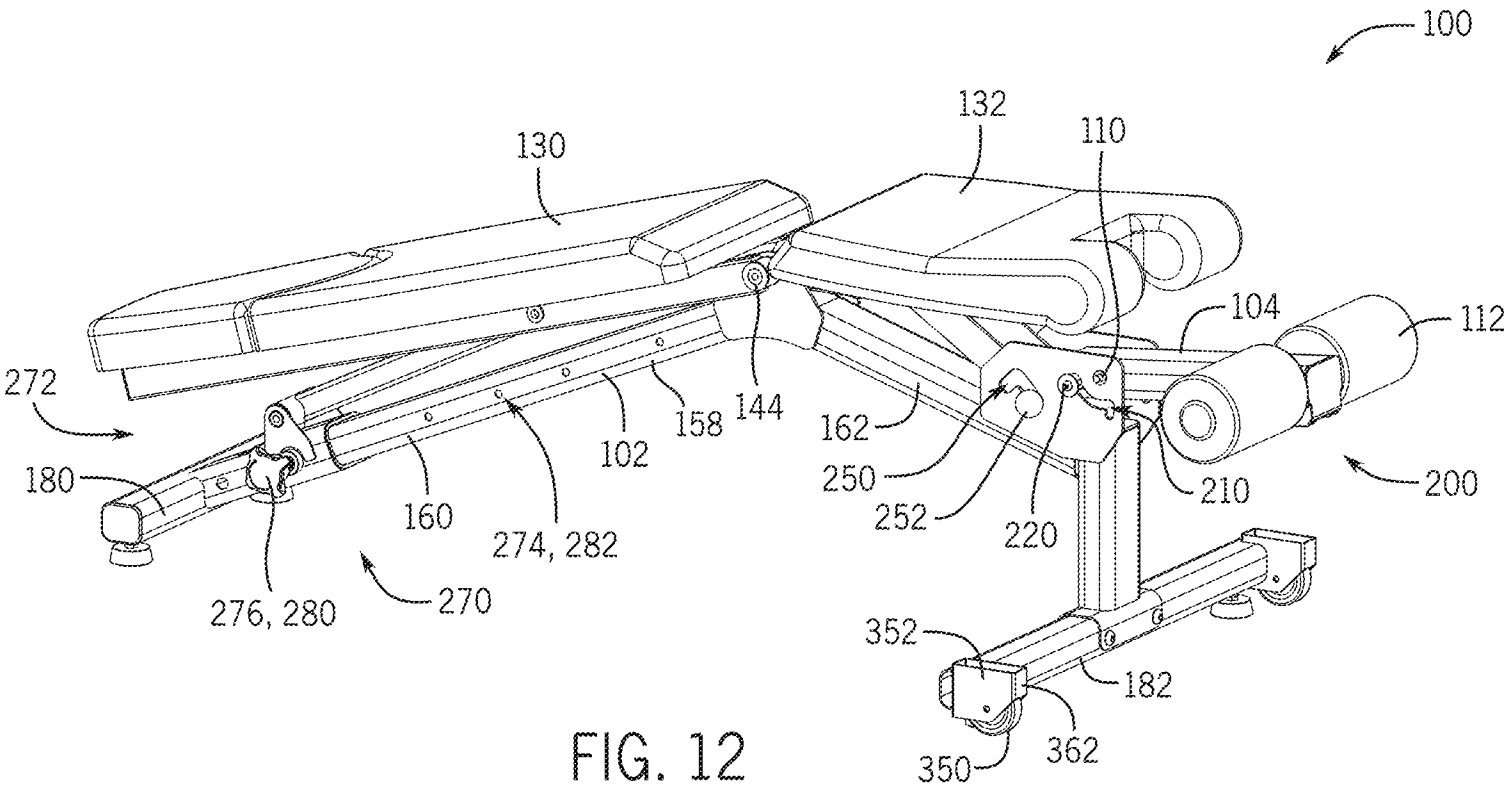
FIG. 12 is an isometric view of an additional exercise bench.
Figure 13:
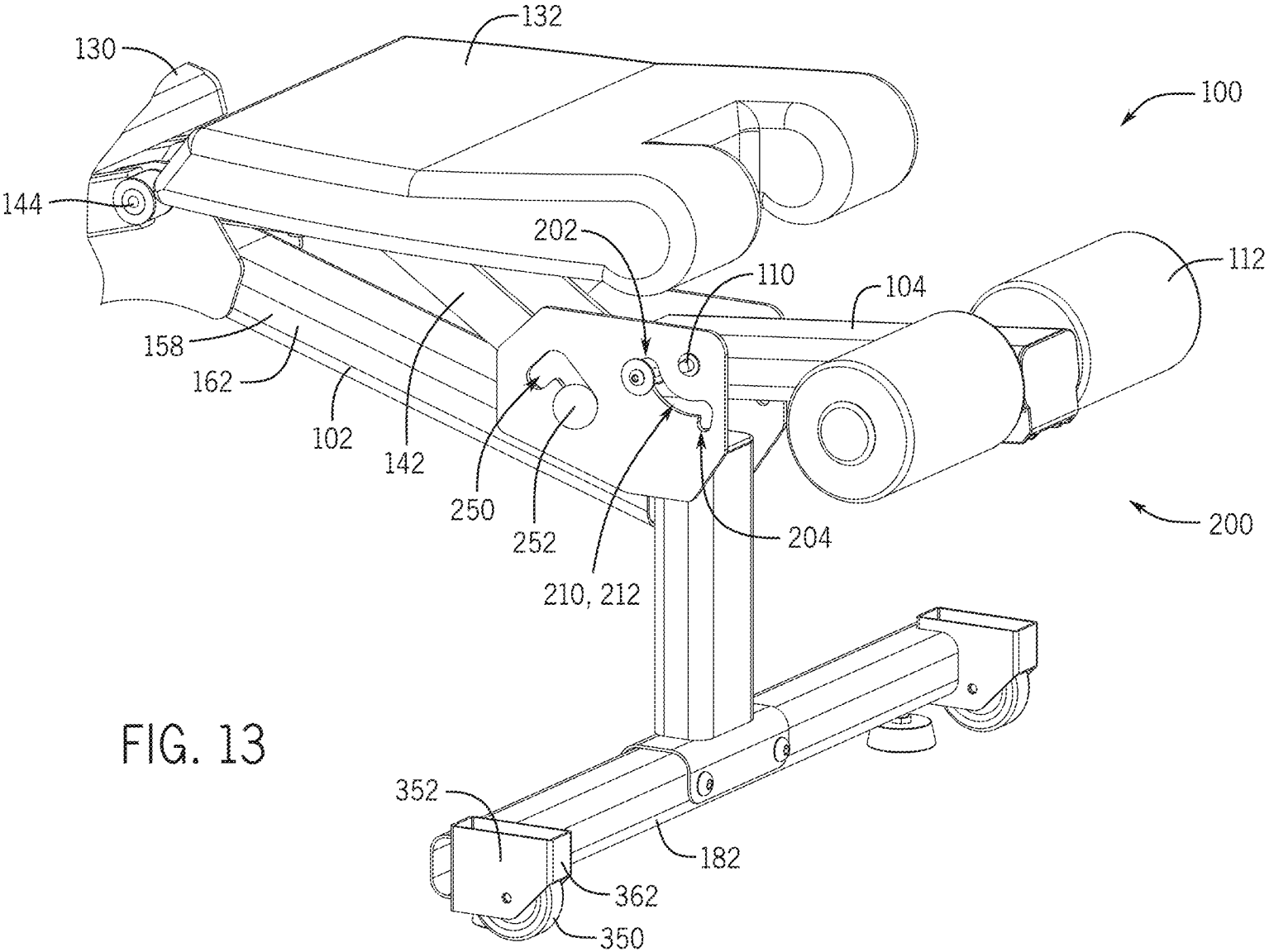
FIG. 13 is an enlarged, fragmentary isometric view of the exercise bench of FIG. 12.
Figure 14:
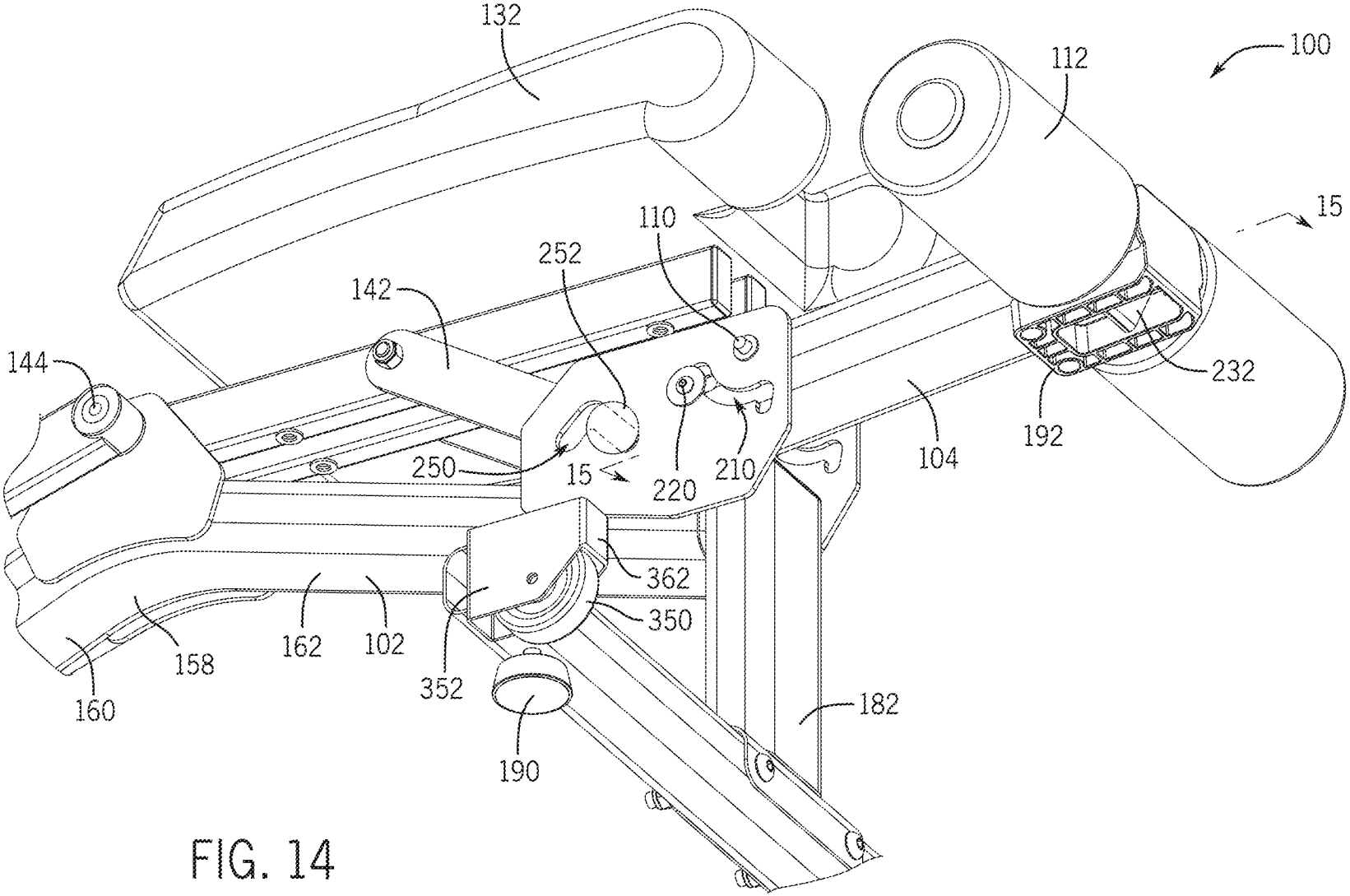
FIG. 14 is another enlarged, fragmentary isometric view of the exercise bench of FIG. 12.

Referring to FIGS. 10 and 11, the exercise bench 100 may include a wheel 350 and a wheel housing 352 operatively associated with the wheel 350 to at least partially cover the wheel 350. In some embodiments, the exercise bench 100 may include a plurality of wheels 350 (e.g., two wheels) and a corresponding number of wheel housings 352. Each wheel 350 may be operable to rollably support the frame 102 on a support surface. For example, the wheel 350 may be coupled to the second floor support 182 (e.g., to the terminal ends 184 of the second floor support 182). In such embodiments, a user may tilt the exercise bench 100 to rollably engage the wheel 350 with the support surface. Once the wheel 350 engages the support surface, the exercise bench 100 may be repositioned or otherwise moved along the support surface via the wheel 350.

The wheel housing 352 may be arranged to support the exercise bench 100 in its upright storage position. To allow movement of the exercise bench 100 along the support surface via the wheel 350, however, the wheel housing 352 may be configured to not engage the support surface when the exercise bench 100 is in its operating position. For example, the wheel housing 352 may be configured to not engage the support surface within a first inclined angular range 360 (see FIG. 10) of the exercise bench 100 to allow the exercise bench 100 to be repositioned along the support surface via the wheel 350. In such embodiments, the wheel housing 352 may be configured to engage the support surface at angles between the first inclined angular range 360 and the upright storage position of the exercise bench 100 to limit the exercise bench 100 from being moved along the support surface within such angles. Depending on the particular application, the first inclined angular range 360 may include angles up to about 25 degrees. In one embodiment, the first inclined angular range 360 may be between about 0 degrees and about 25 degrees, though the first inclined angular range 360 may encompass other angular ranges (e.g., between about 0 degrees and about 15 degrees, between about 0 degrees and about 20 degrees, between about 0 degrees and about 30 degrees, between about 5 degrees and about 25 degrees, between about 10 degrees and about 25 degrees, etc.). In such embodiments, a user may traverse the exercise bench 100 across the support surface via the wheel 350 when the exercise bench 100 is tilted within the first inclined angular range 360.

Tilting the exercise bench 100 beyond the first inclined angular range 360 may engage the wheel housing 352 with the support surface to limit further movement of the exercise bench 100 along the support surface (e.g., for storage). In some embodiments, the wheel housing 352 may define or include a support pad 362. In such embodiments, the support pad 362 of the wheel housing 352 may engage the support surface when the exercise bench 100 is in its upright storage position. The support pads 362 of the wheel housings 352 may define the area 186 in combination with the second support pad 192 of the member 104.

Referring to FIGS. 23-26, the exercise bench 100 may include other features for convenience. For example, the exercise bench 100 may include a handle 370 coupled to the backrest 130 to allow user manipulation of the backrest 130 and/or the exercise bench 100. For example, a user may manipulate the handle 370 to move the backrest 130 between its positions. Additionally or alternatively, a user may manipulate the handle 370 to tilt the exercise bench 100. When tilted within the first inclined angular range 360, the user may manipulate the handle 370 to roll the exercise bench 100 along the support surface via the wheel 350. The handle 370 may include many suitable configurations. For example, the handle 370 may be U-shaped (see FIG. 25) or T-shaped (see FIG. 24), among others. In some embodiments, the handle 370 include a smooth grip portion 372 (see FIGS. 24 and 26).

Operation of the exercise bench 100 will now be discussed in more detail. Depending on user preference and space constraints, the user may desire to store the exercise bench 100, such as in a closet, in the corner of a room, etc. To position the exercise bench 100 for storage, the user may position the backrest 130 in its lowermost position. For example, to lower the backrest 130, the user may disengage the lock mechanism 270 and move the backrest 130 towards the first beam portion 160. Once positioned in its lowermost position, the backrest 130 may be releasably locked in position (e.g., via the lock mechanism 270). Additionally or alternatively, the user may position the seat 132 in its second position. For instance, as described above, the user may lift up on the seat 132 to transition the pin 252 of the seat post 142 from the first track portion 254 to the second track portion 256. Once the pin 252 is within the second track portion 256, the seat 132 may be lowered towards the second beam portion 162 and into its second position.

Once the seat 132 is in its second position, the member 104 may be moved from its operation position to its second position. To move the member 104 into its second position, the user may actuate the adjustment assembly 200. For example, the user may depress, rotate, or otherwise actuate the actuator 232 to disengage the pin 220 from the first detent 202 and position the pin 220 within the transition portion 212 of the track 210. Once the pin 220 is positioned within the transition portion 212 of the track 210, the member 104 may be rotated upwards towards the seat 132 about the pivot axis 110. The member 104 may be rotated about the pivot axis 110 until the pin 220 is positioned proximate the second detent 204, at which point the pin 220 may automatically engage the second detent 204 under the bias provided by the spring 230 of the adjustment assembly 200.

Once the member 104 is positioned in its second position, the user may tilt the exercise bench 100 on end to engage the support pads 362, 192 defined on the wheel housings 352 and the member 104 with the support surface. As shown in FIG. 9, the relative geometries and positioning of the components may be such that the exercise bench 100 is stored substantially vertically. When positioned vertically, the center of gravity of the exercise bench 100 may be positioned to limit undesired tipping of the exercise bench 100 to any side, thereby reducing the likelihood of potential injury or property damage resulting from the exercise bench 100 falling over.

The exercise bench 100 may be removed from storage and positioned in its operating position in substantially the reverse order discussed above. For example, the user may lower the exercise bench 100 from a vertical position until the first and second floor supports 180, 182 engage the support surface. Once lowered, the member 104 may be moved to its first position by releasing the pin 220 from the second detent 204 and rotating the member 104 downwards until the pin 220 automatically engages the first detent 202 via the adjustment assembly 200. Once the member 104 is lowered into its first position, the seat 132 may be raised to its first position by raising the seat 132 until the pin 252 is received within the first track portion 254 of the seat track 250, whereupon the seat 132 is lowered into is first position. Depending on the exercise to be performed, the backrest 130 may be raised to a desired position relative to the frame 102.

The exercise bench 100 may be formed from a variety of materials and means. For instance, the exercise bench 100 may be formed from metal, plastic, or any other suitable material with sufficient strength. In some embodiments, portions of the exercise bench 100 (e.g., the frame 102, the member 104, etc.) may be extruded from metal or another thermoformable material. Metals may include aluminum, steel, titanium, or any other suitable metal, alloy, or composite. Plastics may include a thermoplastic material (self-reinforced or fiber reinforced), nylon, LDPE, ABS, polycarbonate, polypropylene, polystyrene, PVC, polyamide, and/or PTFE, among others, and may be formed or molded in any suitable manner, such as by plug molding, blow molding, injection molding, extrusion, or the like. In some embodiments, at least some of the components of the exercise bench 100 (e.g., the frame 102, the first and second floor supports 180, 182, and the member 104, among others) may be coated with a vinyl, a rubberized material, or any other coating for increased durability.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed:

1. A storable exercise bench comprising:
a frame including a beam operatively coupled to a first floor support and a second floor support;
a seat supported by the frame;
a backrest pivotally coupled to the frame; and
a member operatively coupled to the beam;
wherein:
the beam runs generally horizontally in reference to a support surface when the exercise bench is positioned into an operating position in which the first and second floor supports the at least one beam and the member;
the beam runs generally vertically in reference to the support surface when the exercise bench is positioned into a storage position in which the second floor support and the member support the beam and the first floor support;
the member is selectively movable between a first position and a second position for supporting the exercise bench when the exercise bench is positioned in the storage position; and
the seat is movable between a first position in which the member is inhibited from moving from its first position to its second position and a second position in which the member is free to move from its first position to its second position.

2. The storable exercise bench of claim 1, further comprising an adjustment assembly operable to selectively position the member in its first and second positions.

3. The storable exercise bench of claim 2, wherein the adjustment assembly, comprises:
first and second detents operatively associated with the frame; and
a pin movably coupled with the member and selectively engaged with the first and second detents to position the member in its first and second positions, respectively.

4. The storable exercise bench of claim 3, further comprising an actuator operable to selectively disengage the pin from the first and second detents.

5. The storable exercise bench of claim 4, wherein the actuator is a lever or a push plate associated with the member.

6. The storable exercise bench of claim 3, wherein the pin is selectively positioned within the first and second detents to position the member in its first and second positions, respectively.

7. The storable exercise bench of claim 3, wherein the pin is spring-actuated to bias the pin into engagement with the first and second detents.

8. The storable exercise bench of claim 1, further comprising a seat post at least partially received within a track defined within the beam, the track shaped such that movement of the seat post within the track moves the seat between its first and second positions.

9. The storable exercise bench of claim 8, wherein the track is V-shaped or U-shaped.

10. The storable exercise bench of claim 1, wherein the exercise bench is supported by three spaced-apart support points provided by the member and the second floor support when the exercise bench is in the storage position.

11. The storable exercise bench of claim 10, wherein the second floor support is U-shaped.

12. The storable exercise bench of claim 1, further comprising an ankle pad operatively coupled with the member, wherein the ankle pad inhibits movement of the member into its second position by contacting the seat when the seat is in the first position.

13. The storable exercise bench of claim 1, further comprising:

a wheel operable to rollably support the frame on the support surface; and a wheel housing operatively associated with the wheel to at least partially cover the wheel, the wheel housing arranged to support the exercise bench in the upright position.

14. A storable exercise bench comprising:

a frame including a beam operatively coupled to first and second floor supports;

a seat supported by the frame;

a backrest pivotally coupled to the frame;

a wheel coupled to the first floor support or the second floor support;

a wheel housing operatively associated with the wheel to at least partially cover the wheel; and a member coupled to the beam such that the member is above a support surface when the exercise bench is in an operating position, and wherein the exercise bench is positionable in an upright storage position in which the member and the wheel housing contact the support surface to support the exercise bench in the upright storage position in which the beam runs generally vertically in reference to the support surface.

15. The storable exercise bench of claim 14, wherein the wheel housing is configured to not contact the support surface within a first inclined angular range of the exercise bench to allow the exercise bench to be repositioned along the support surface via the wheel.

16. The storable exercise bench of claim 15, wherein the wheel housing is configured to contact the support surface at angles between the first inclined angular range and the upright storage position of the exercise bench to limit the exercise bench from being moved along the support surface.

17. The storable exercise bench of claim 14, wherein the wheel housing is configured to not contact the support surface when the exercise bench is in the operating position in which the beam runs generally horizontally relative to the support surface.

18. The storable exercise bench of claim 14, wherein the seat is pivotally coupled to the frame such that the seat and the backrest pivot about a common pivot axis.

19. A storable exercise bench comprising:

a backrest;

a seat;

a frame including a first beam portion supporting the backrest and a second beam portion supporting the seat, wherein the backrest is movably coupled to the frame, wherein the frame further includes a first floor support coupled to the first beam portion and a second floor support coupled to the second beam portion, wherein the second floor support defines support points laterally outward from the first and second beam portions;

a member coupled to the frame and movable between a first position and a second position in which the member is positioned to support the exercise bench in a storage position together with the support points; and wherein the seat includes a cut-out, and wherein the member is received in the cutout when the member is in its second position.

* * * * *